US011406156B2

(12) United States Patent
Champagne et al.

(10) Patent No.: US 11,406,156 B2
(45) Date of Patent: Aug. 9, 2022

(54) PROTECTOR FOR PROTECTING A SKATE AND A USER'S FOOT

(71) Applicant: BAUER HOCKEY LTD., Blainville (CA)

(72) Inventors: Gaetan Champagne, Saint-Colomban (CA); Jean-Francois Corbeil, Prevost (CA)

(73) Assignee: BAUER HOCKEY LLC, Exeter, NH (US)

( * ) Notice: Subject to any disclaimer, the term of this patent is extended or adjusted under 35 U.S.C. 154(b) by 0 days.

(21) Appl. No.: 16/414,298

(22) Filed: May 16, 2019

(65) Prior Publication Data

US 2020/0359734 A1 Nov. 19, 2020

(51) Int. Cl.

| | |
|---|---|
| ***A43B 5/16*** | (2006.01) |
| ***A43B 5/18*** | (2006.01) |
| *A63B 71/12* | (2006.01) |

(52) U.S. Cl.

CPC ..... *A43B 5/1616* (2013.01); *A43B 5/1666* (2013.01); *A43B 5/18* (2013.01); *A63B 2071/1283* (2013.01)

(58) Field of Classification Search

CPC ..... A43B 5/18; A43B 5/16; A43B 5/1616

See application file for complete search history.

(56) References Cited

U.S. PATENT DOCUMENTS

| | | | | | |
|---|---|---|---|---|---|
| 11,947 | A * | 11/1854 | Pease | A43B 7/06 | 36/3 A |
| 369,766 | A * | 9/1887 | Barney | A43B 23/28 | 36/58.5 |
| 395,271 | A * | 12/1888 | Fry et al. | A43B 3/16 | 36/58.6 |
| 3,006,084 | A * | 10/1961 | Le Compte | A43B 3/02 | 36/7.3 |
| 3,027,660 | A * | 4/1962 | Werner | A43B 5/18 | 36/7.1 R |
| 3,176,416 | A * | 4/1965 | Seegert | A43B 5/18 | 36/7.1 R |
| 4,351,537 | A * | 9/1982 | Seidel | A43B 5/1616 | 280/11.12 |
| 5,234,230 | A * | 8/1993 | Crane | A63C 3/00 | 280/811 |
| 5,829,170 | A * | 11/1998 | Lutz, Jr. | A43B 5/1683 | 36/72 R |
| 6,460,274 | B1 * | 10/2002 | Mateu | A43B 5/0401 | 36/115 |
| 7,021,663 | B1 * | 4/2006 | Moran | A43B 5/1666 | 280/11.12 |
| 7,523,567 | B1 * | 4/2009 | McClelland | A43B 5/1666 | 36/115 |

(Continued)

*Primary Examiner* — Jila M Mohandesi

(57) ABSTRACT

A protector for protecting a skate (e.g., an ice skate) and a foot of a user (e.g., a hockey player) against impacts, such as from pucks (e.g., during shots, which can be powerful), to reduce risks of pain or injury from such impacts, in which the protector is fastenable to the skate, is configured to cover at least part of a skate boot of the skate, and may be designed to facilitate its use, including by facilitating the user donning (i.e., putting on) and doffing (i.e., removing) the skate (e.g., while the protector is fastened to the skate boot), and/or to look like the skate boot (e.g., so as to be relatively unnoticeable such that it can seem as if it is not there).

39 Claims, 29 Drawing Sheets

(56) References Cited

U.S. PATENT DOCUMENTS

| | | | | |
|---|---|---|---|---|
| 8,959,801 | B1 * | 2/2015 | Siragusa, Jr. | A63B 71/1225 36/72 R |
| 2004/0016150 | A1 * | 1/2004 | Labonte | A43B 7/16 36/115 |
| 2004/0083625 | A1 * | 5/2004 | Wilder | A43B 5/1666 36/115 |
| 2005/0241189 | A1 * | 11/2005 | Elkington | A43B 5/0405 36/117.6 |
| 2008/0098625 | A1 * | 5/2008 | Salvatore | A43B 3/0031 36/132 |
| 2010/0325922 | A1 * | 12/2010 | Esposito | A43C 13/00 36/72 R |
| 2011/0016617 | A1 * | 1/2011 | Shrewsburg | A43B 5/18 2/411 |
| 2011/0016752 | A1 * | 1/2011 | Koyess | A43D 8/22 36/115 |

* cited by examiner

PROTECTOR FOR PROTECTING A SKATE AND A USER'S FOOT

FIELD

This disclosure relates generally to skates (e.g., ice skates), such as for playing hockey, and, more particularly, to protection of skates and users' feet.

BACKGROUND

Skates are used by users in various sports such as ice hockey, roller hockey, etc., in which they may be impacted, such as by pucks or balls (e.g., during shots, passes, etc.), hockey sticks (e.g., during slashing), etc.

Although skates are typically made of strong materials, there are risks of pain or injury when they are impacted forcefully, such as by pucks at high speeds during powerful shots.

Protectors mountable over skates have thus been developed to provide additional impact protection. While they are useful, these protectors present certain drawbacks, such as making it harder or complicated to use the skates, hiding or otherwise detrimentally affecting how the skates look, fitting inadequately over the skates, etc.

For these and/or other reasons, there is a need for improvements directed to impact protection for skates and users' feet.

SUMMARY

In accordance with various aspects, this disclosure relates to a protector for protecting a skate (e.g., an ice skate) and a foot of a user (e.g., a hockey player) against impacts, such as from pucks (e.g., during shots, which can be powerful), to reduce risks of pain or injury from such impacts, in which the protector is fastenable to the skate, is configured to cover at least part of a skate boot of the skate, and may be designed to facilitate its use, including by facilitating the user donning (i.e., putting on) and doffing (i.e., removing) the skate (e.g., while the protector is fastened to the skate boot), and/or to look like the skate boot (e.g., so as to be relatively unnoticeable such that it can seem as if it is not there).

For example, in accordance with an aspect, this disclosure relates to a protector for protecting a skate and a foot of a user against impacts. The skate comprises a skate boot defining a cavity configured to receive the user's foot. The skate comprises a skating device disposed beneath the skate boot to engage a skating surface. The protector comprises: a cover configured to cover at least part of the skate boot and provide impact protection; and a fastening system configured to fasten the protector to the skate. The protector allows the user to don and doff the skate while the fastening system fastens the protector to the skate.

In accordance with another aspect, this disclosure relates to a protector for protecting a skate and a foot of a user against impacts. The skate comprises a skate boot defining a cavity configured to receive the user's foot. The skate boot comprises a medial side portion configured to face a medial side of the user's foot, a lateral side portion configured to face a lateral side of the user's foot, an ankle portion configured to receive an ankle of the user, a heel portion configured to receive a heel of the user's foot, a sole portion configured to face a plantar surface of the user's foot, and a toe portion configured to receive toes of the user's foot, the skate comprising a skating device disposed beneath the skate boot to engage a skating surface. The protector comprises: a cover configured to cover at least part of the skate boot and provide impact protection, the cover comprising a medial wall configured to cover at least part of the medial side portion of the skate boot, a lateral wall configured to cover at least part of the lateral side portion of the skate boot, and a heel wall configured to cover at least part of the heel portion of the skate boot; and a fastening system configured to fasten the protector to the skate.

In accordance with another aspect, this disclosure relates to a protector for protecting a skate and a foot of a user against impacts. The skate comprises a skate boot defining a cavity configured to receive the user's foot. The skate boot comprises an instep portion configured to face an instep of the user's foot. The skate comprises a skating device disposed beneath the skate boot to engage a skating surface. The protector comprises: a cover configured to cover at least part of the skate boot, leave the instep portion of the skate boot exposed, and provide impact protection; and a fastening system configured to fasten the protector to the skate.

In accordance with another aspect, this disclosure relates to a protector for protecting a skate and a foot of a user against impacts. The skate comprises a skate boot defining a cavity configured to receive the user's foot. The skate boot comprises an instep portion configured to face an instep of the user's foot. The skate comprises a skating device disposed beneath the skate boot to engage a skating surface. The protector comprises: a cover configured to cover at least part of the skate boot, define an opening over the instep portion of the skate boot, and provide impact protection; and a fastening system configured to fasten the protector to the skate.

In accordance with another aspect, this disclosure relates to a protector for protecting a skate and a foot of a user against impacts. The skate comprises a skate boot defining a cavity configured to receive the user's foot. The skate boot comprises a medial side portion configured to face a medial side of the user's foot, a lateral side portion configured to face a lateral side of the user's foot, and a tongue extending between the medial side portion and the lateral side portion of the skate boot and configured to face an instep of the user's foot. The skate comprises a skating device disposed beneath the skate boot to engage a skating surface. The protector comprises: a cover configured to cover at least part of the skate boot, leave the tongue exposed where the tongue faces the instep of the user's foot, and provide impact protection; and a fastening system configured to fasten the protector to the skate.

In accordance with another aspect, this disclosure relates to a protector for protecting a skate and a foot of a user against impacts. The skate comprises a skate boot defining a cavity configured to receive the user's foot. The skate boot comprises a medial side portion configured to face a medial side of the user's foot, a lateral side portion configured to face a lateral side of the user's foot, and a tongue extending between the medial side portion and the lateral side portion of the skate boot and configured to face an instep of the user's foot. The skate comprises a skating device disposed beneath the skate boot to engage a skating surface. The protector comprises: a cover configured to cover at least part of the skate boot, provide impact protection, and define an opening over the tongue; and a fastening system configured to fasten the protector to the skate.

In accordance with another aspect, this disclosure relates to a protector for protecting a skate and a foot of a user against impacts. The skate comprises a skate boot defining a cavity configured to receive the user's foot. The skate comprises a skating device disposed beneath the skate boot to engage a skating surface. The protector comprises: a cover configured to cover at least part of the skate boot without extending over a top surface of the user's foot and to provide impact protection; and a fastening system configured to fasten the protector to the skate.

In accordance with another aspect, this disclosure relates to a protector for protecting a skate and a foot of a user against impacts. The skate comprises a skate boot defining a cavity configured to receive the user's foot. The skate boot comprises a lace for tightening the skate boot about the user's foot. The skate comprises a skating device disposed beneath the skate boot to engage a skating surface. The protector comprises: a cover configured to cover at least part of the skate boot and provide impact protection; and a fastening system configured to fasten the protector to the skate, the fastening system comprising a lacing opening configured to receive the lace.

In accordance with another aspect, this disclosure relates to a protector for protecting a skate and a foot of a user against impacts. The skate comprises a skate boot defining a cavity configured to receive the user's foot. The skate comprises a skating device disposed beneath the skate boot to engage a skating surface. The protector comprises: a cover configured to cover at least part of the skate boot and provide impact protection, the cover comprising a plurality of layers that include a plurality of materials different from one another; and a fastening system configured to fasten the protector to the skate.

In accordance with another aspect, this disclosure relates to a protector for protecting a skate and a foot of a user against impacts. The skate comprises a skate boot defining a cavity configured to receive the user's foot. The skate comprises a skating device disposed beneath the skate boot to engage a skating surface. The protector comprises: a cover configured to cover at least part of the skate boot, shaped during original manufacturing to conform to an external surface of the skate boot, and configured to provide impact protection; and a fastening system configured to fasten the protector to the skate.

In accordance with another aspect, this disclosure relates to a protector for protecting a skate and a foot of a user against impacts. The skate comprises a skate boot defining a cavity configured to receive the user's foot. The skate comprises a skating device disposed beneath the skate boot to engage a skating surface. The protector comprises: a cover configured to cover at least part of the skate boot and provide impact protection, an appearance of an outer side of the cover being configured to emulate an appearance of an exterior of the skate boot; and a fastening system configured to fasten the protector to the skate.

These and other aspects of this disclosure will now become apparent to those of ordinary skill in the art upon review of a description of embodiments in conjunction with drawings annexed hereto.

BRIEF DESCRIPTION OF DRAWINGS

A detailed description of embodiments is provided below, by way of example only, with reference to drawings annexed hereto, in which.

It is to be expressly understood that the description and drawings are only for purposes of illustration and as an aid to understanding, and are not intended to be limiting.

DETAILED DESCRIPTION OF EMBODIMENTS

Figure 1:
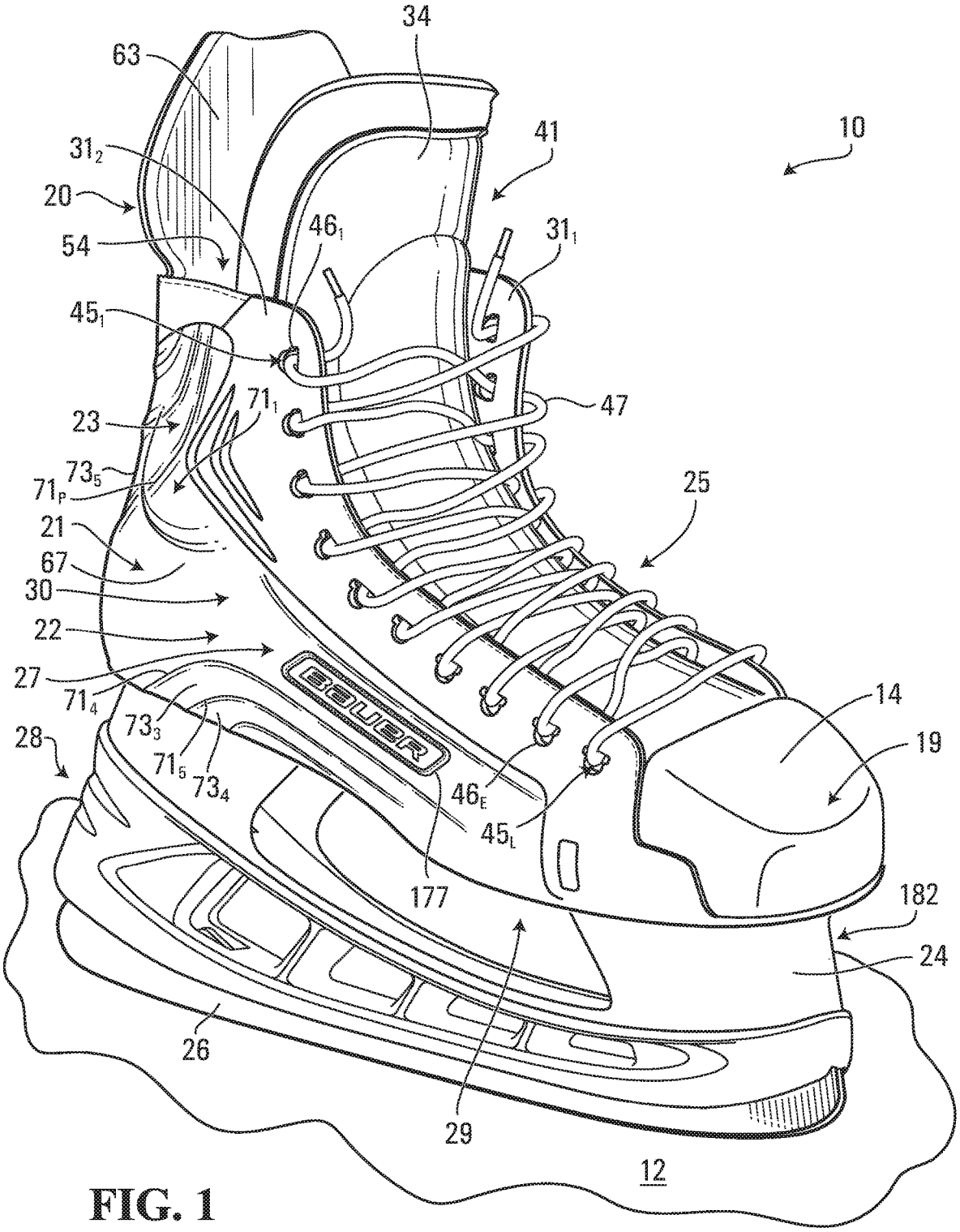
FIG. 1 is an example of an embodiment of a skate for a user.
Figure 2:
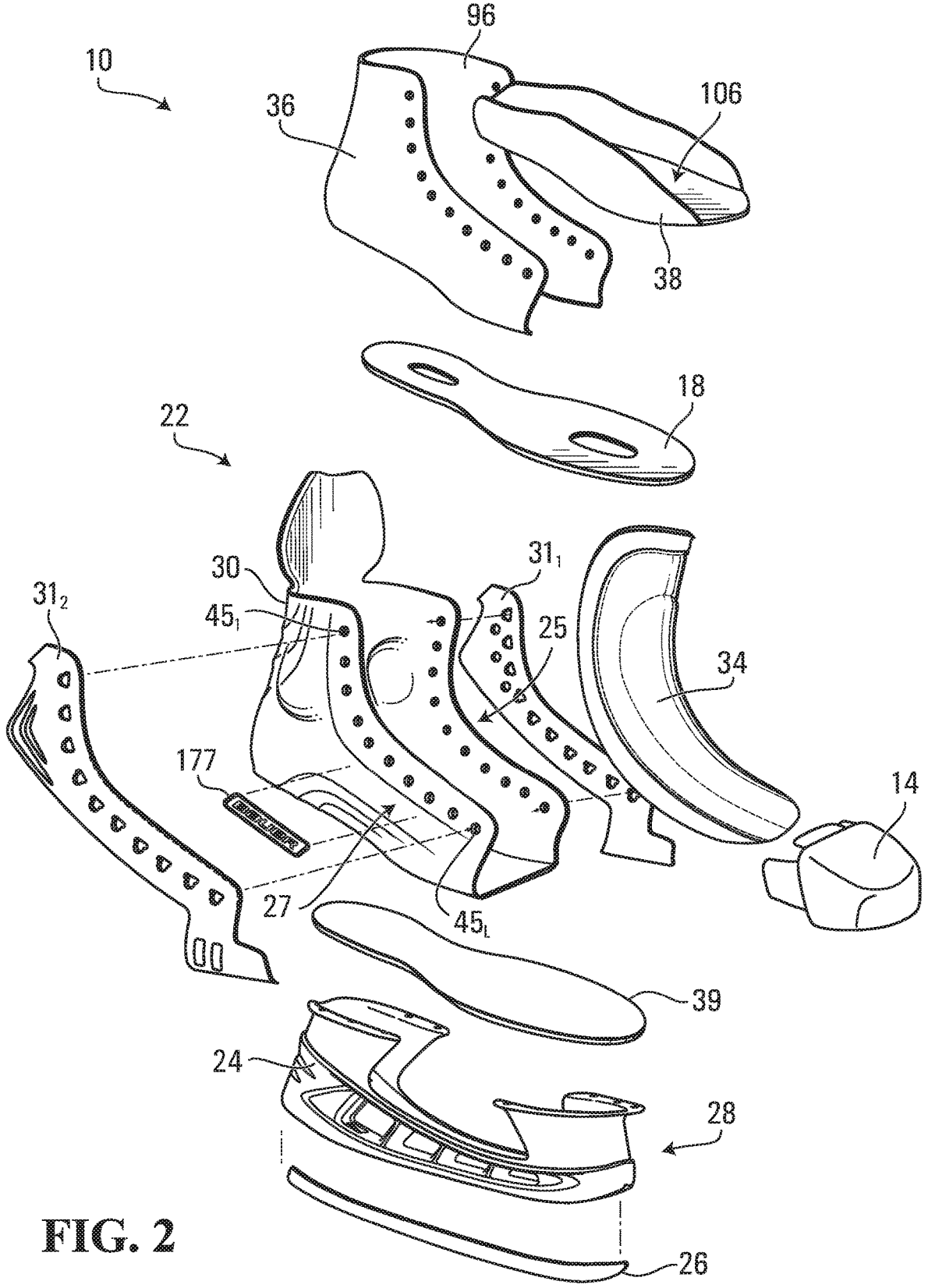
FIG. 2 is an exploded view of the skate.
Figure 3:
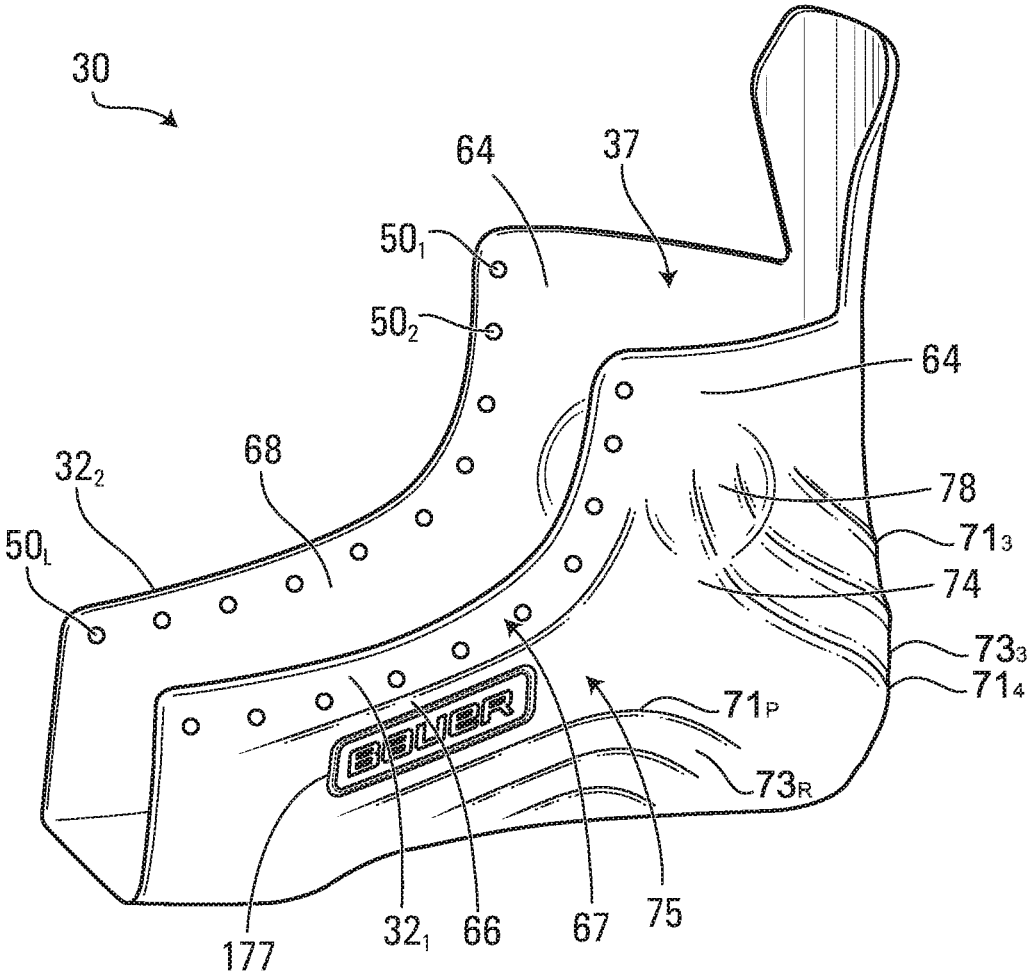
FIGS. 3 to 5 are perspective views of a body of a skate boot of the skate.
Figure 4:
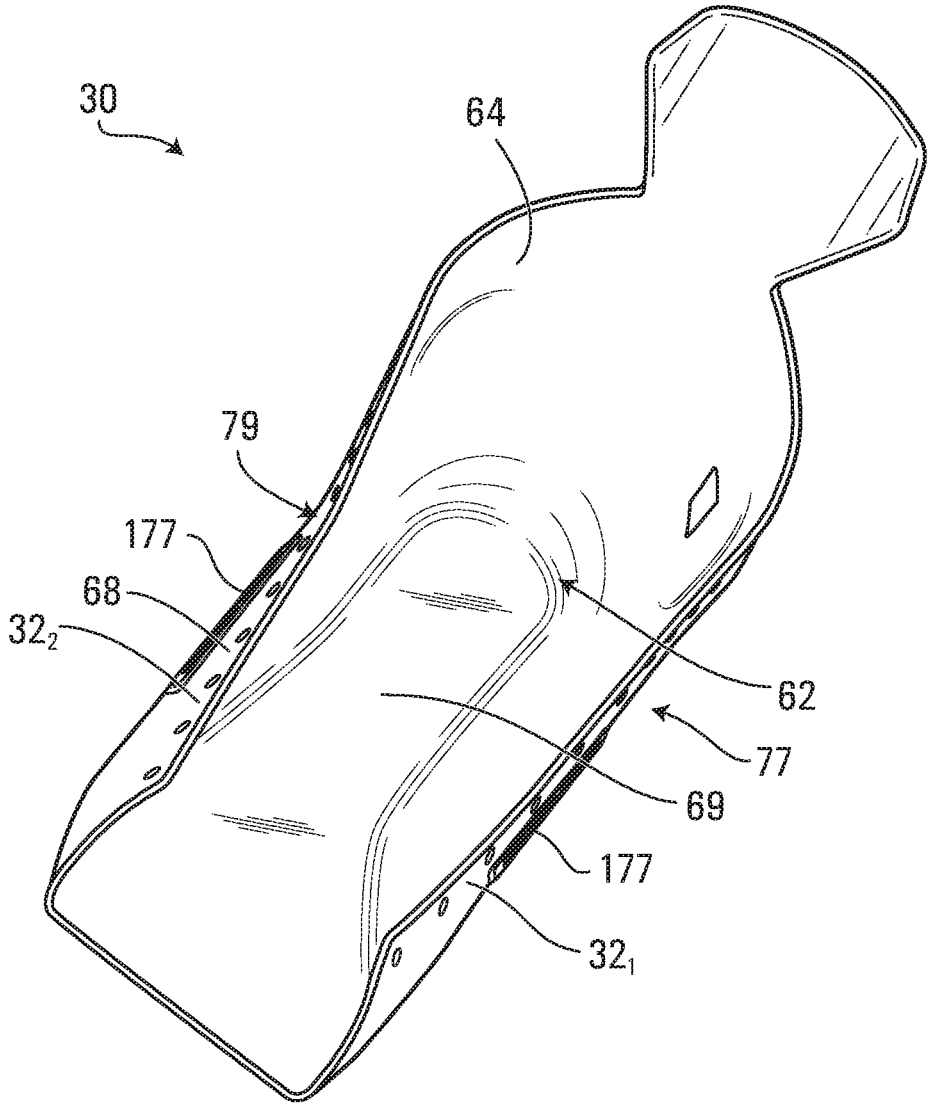
Figure 5:
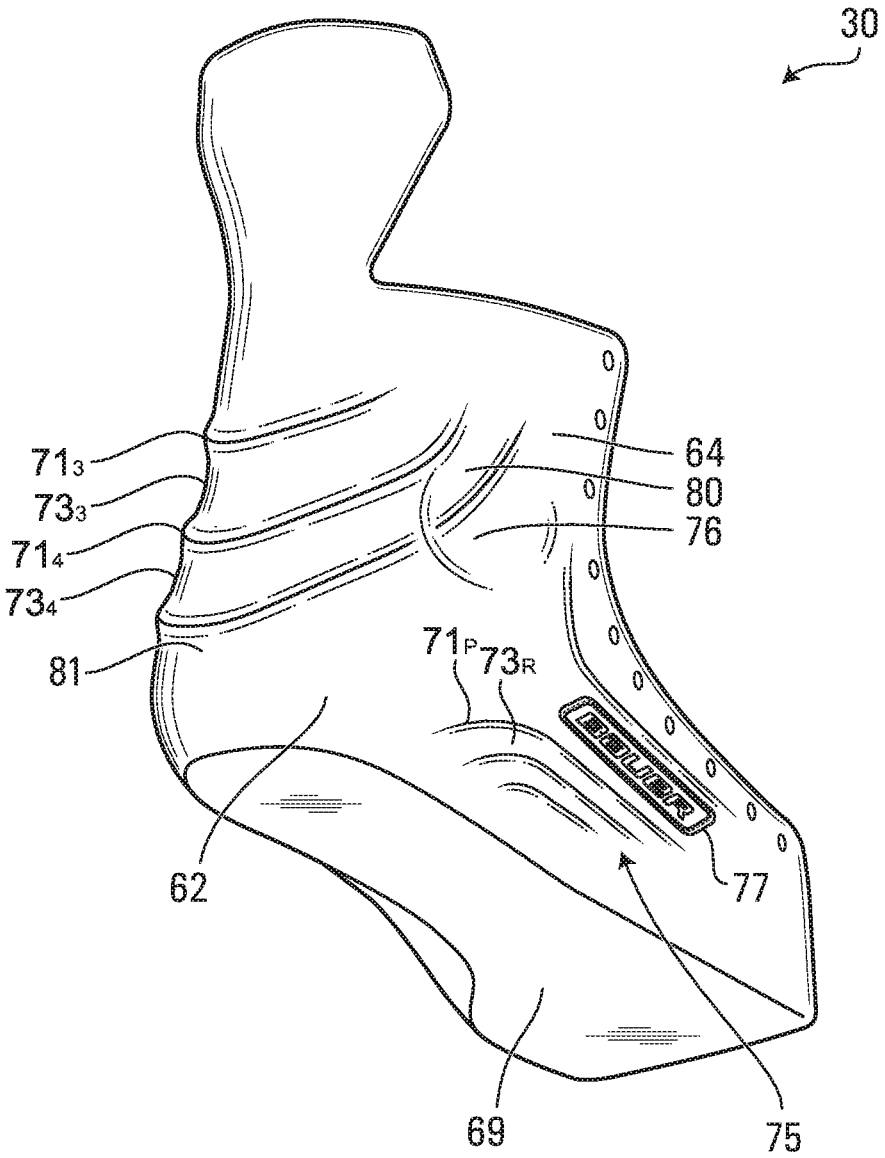
Figure 7:
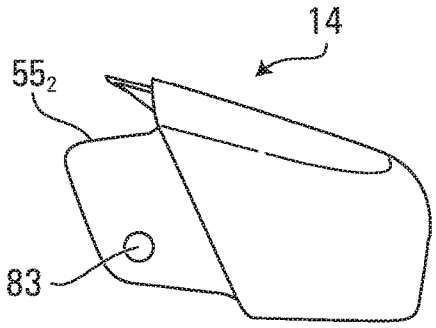
FIGS. 6 and 7 show different views of a toe cap of the skate boot.
Figure 6:
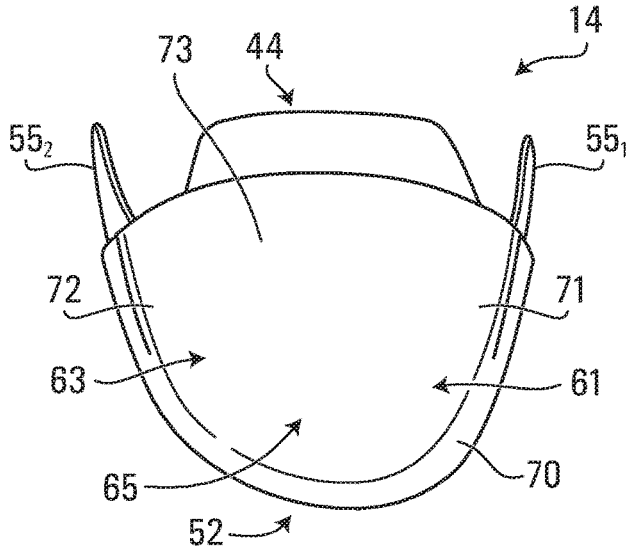

FIG. 1 shows an example of an embodiment of a skate 10 for a user to skate on a skating surface 12. In this embodiment, the skate 10 is a hockey skate for the user who is a hockey player playing hockey. In this example, the skate 10 is an ice skate, a type of hockey played is ice hockey, and the skating surface 12 is ice.

The skate 10 comprises a skate boot 22 for receiving a foot 11 of the player and a skating device 28 disposed beneath the skate boot 22 to engage the skating surface 12. In this embodiment, the skating device 28 comprises a blade 26 for contacting the ice 12 and a blade holder 24 between the skate boot 22 and the blade 26. The skate 10 has a longitudinal direction, a widthwise direction, and a heightwise direction.

Figure 11:
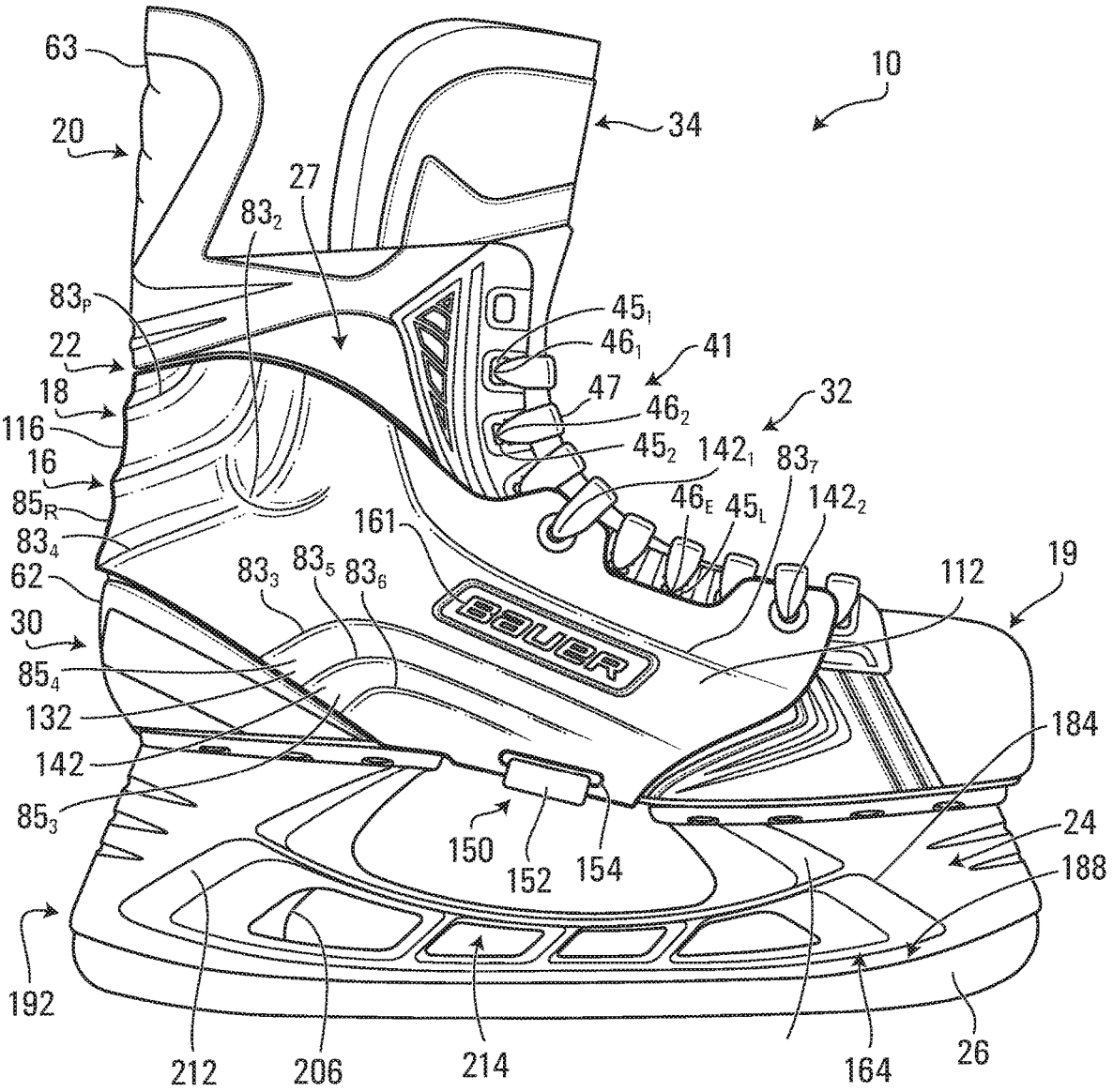
FIG. 11 is a lateral side view of the skate and a protector according to an embodiment of the disclosure.
Figure 12:
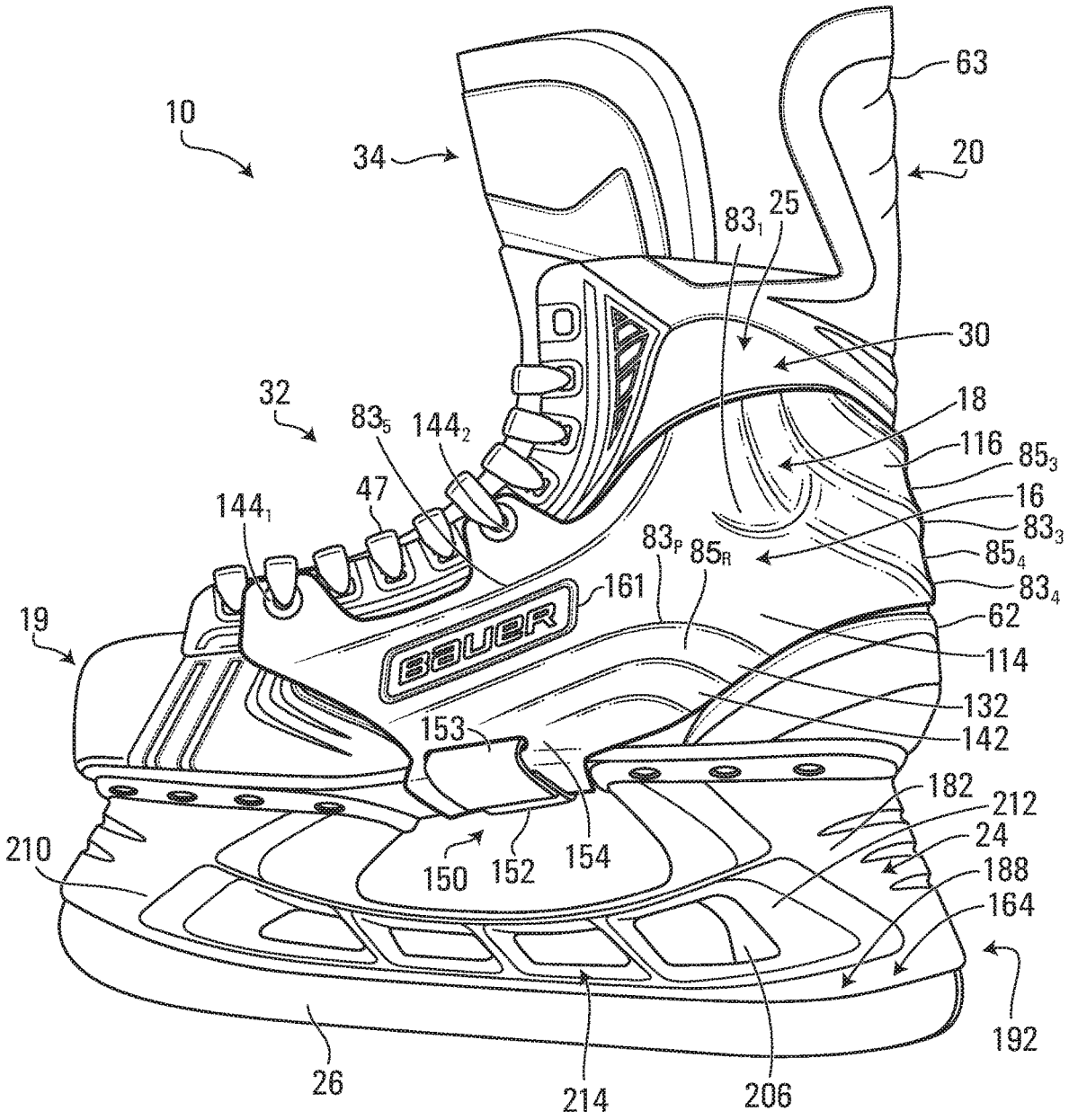
FIG. 12 is a medial side view of the skate and protector.
Figure 13:
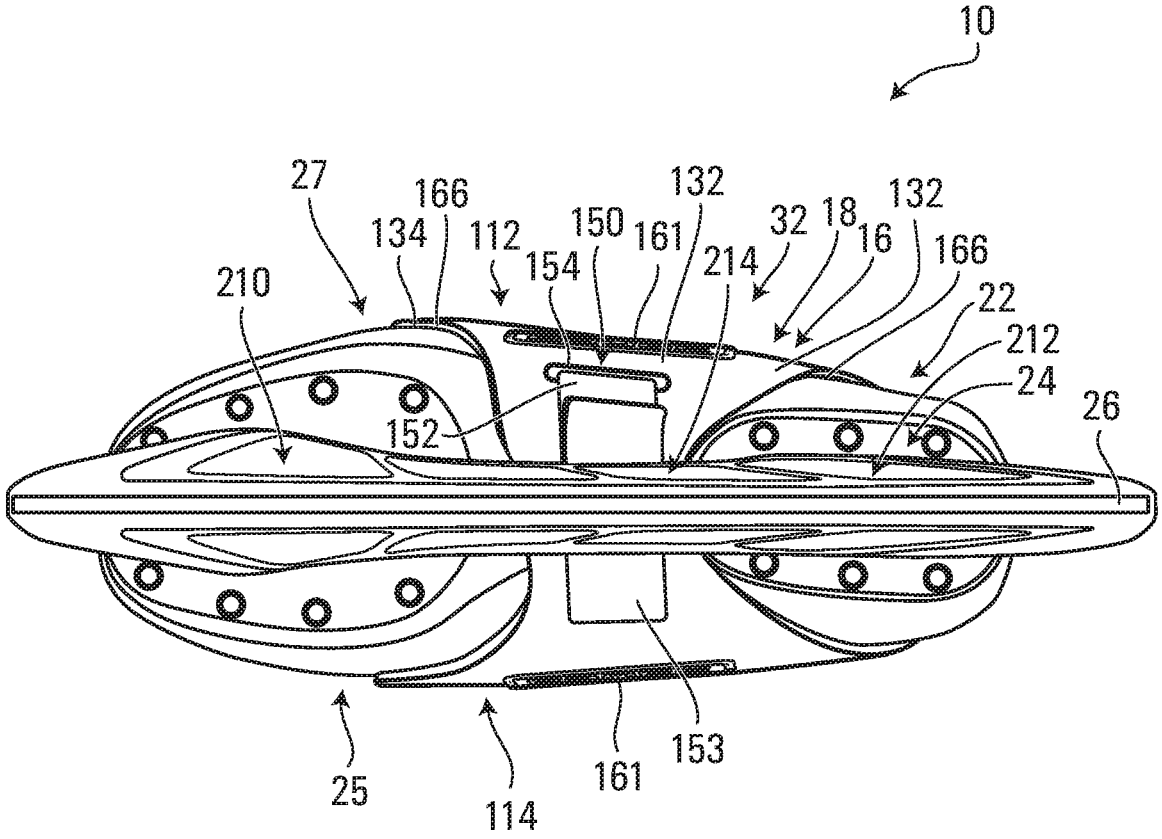
FIG. 13 is a bottom view of the skate and protector.
Figure 14:
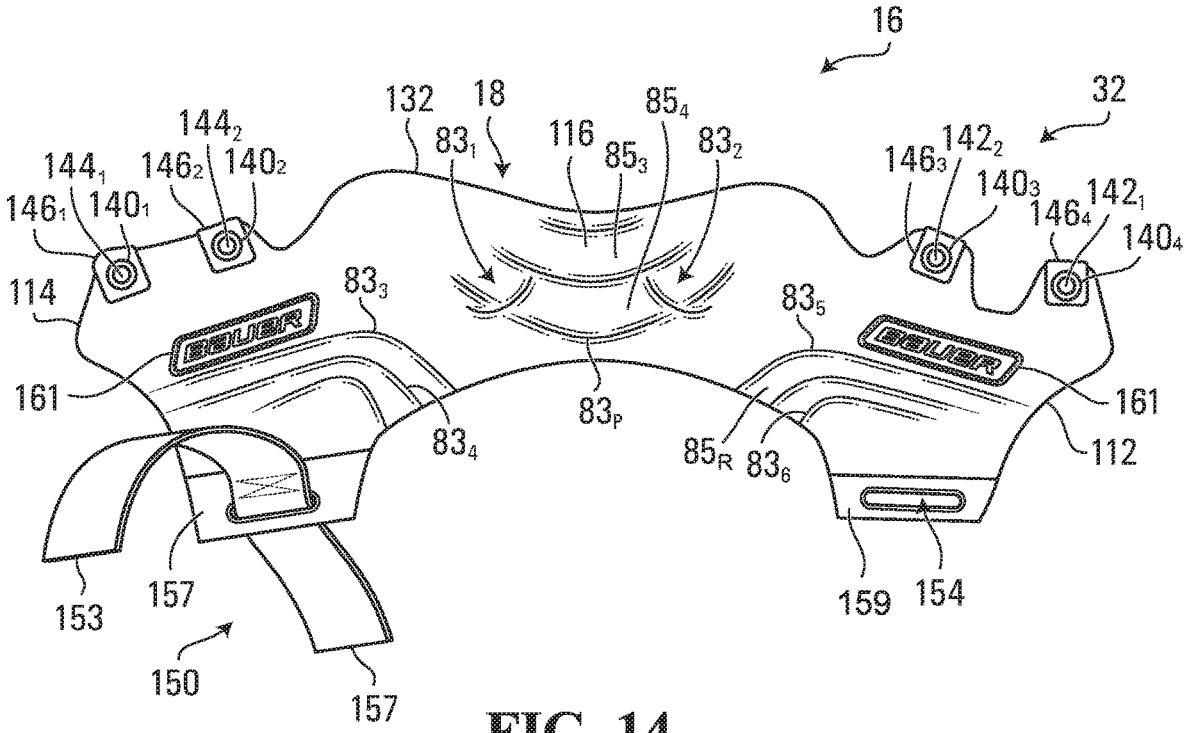
FIG. 14 is a flat view of the protector.
Figure 15:
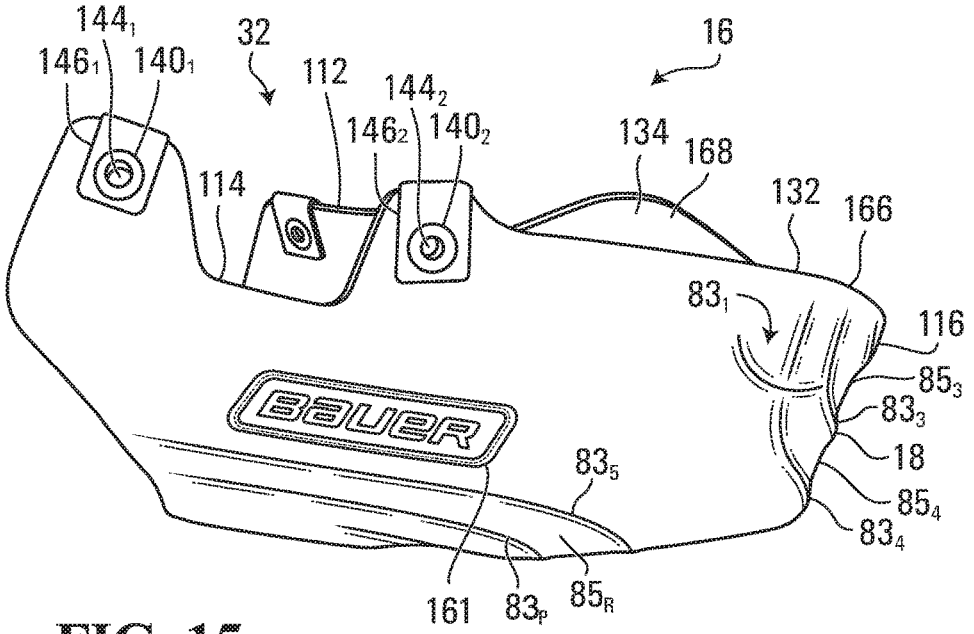
FIGS. 15 to 18 are lateral side, medial side, top and back side views of the protector.
Figure 16:
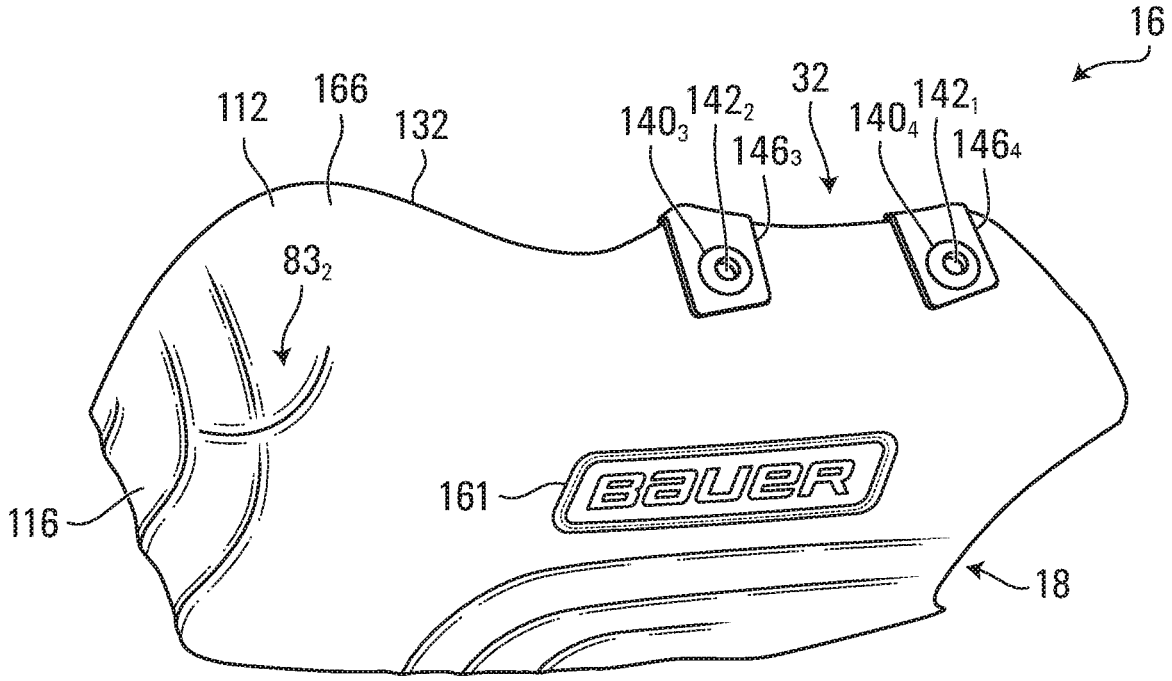
Figure 17:
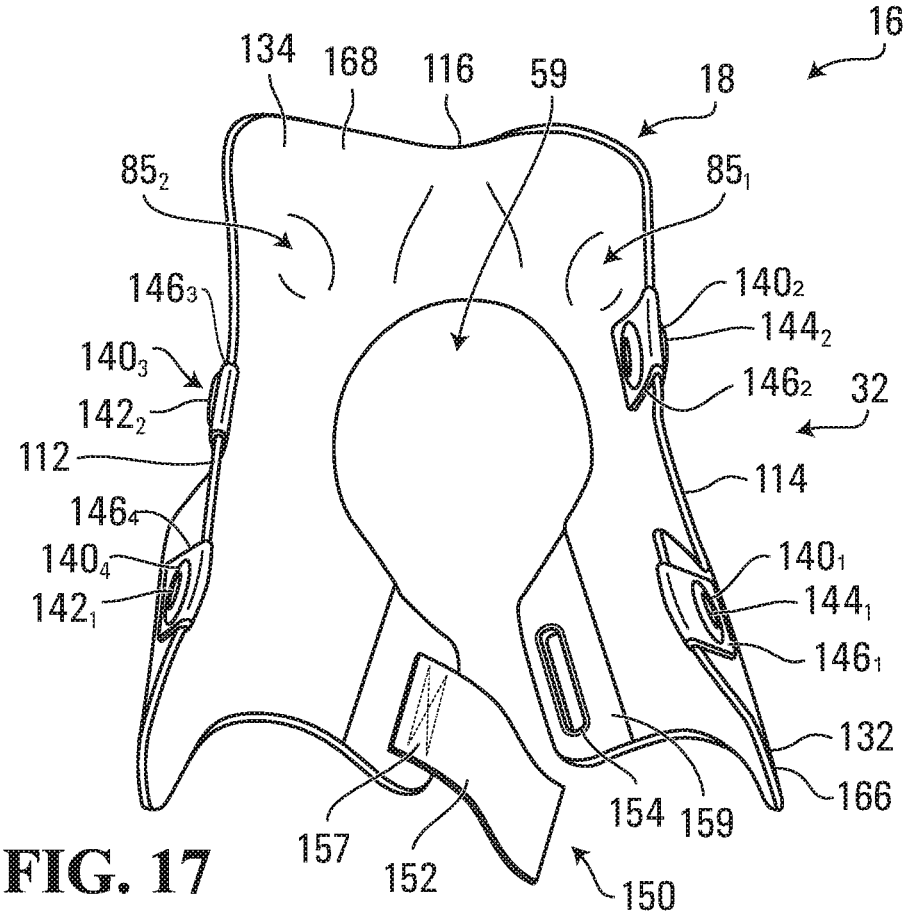
Figure 18:
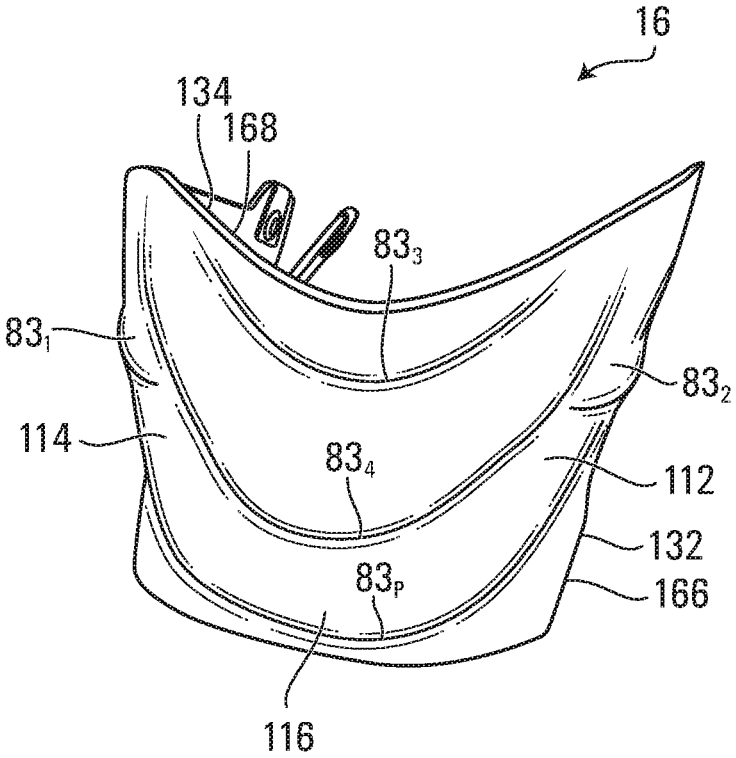

As shown in FIGS. 11 to 13, in this embodiment, as further discussed below, the skate 10 comprises a protector 16 for protecting the skate 10 and the user's foot 11 against impacts, notably from pucks (e.g., during shots, which can be powerful), to reduce risks of pain or injury from such impacts. In that sense, the protector 16 may sometimes be referred to as a "foot protector" or "skate protector". The protector 16 may be designed to facilitate its use, including by facilitating the user donning (i.e., putting on) and doffing (i.e., removing) the skate 10 (e.g., while the protector 10 is fastened to the skate boot 22), and/or to look like the skate boot 22 (e.g., so as to be relatively unnoticeable such that it can seem as if it is not there).

Figure 43:
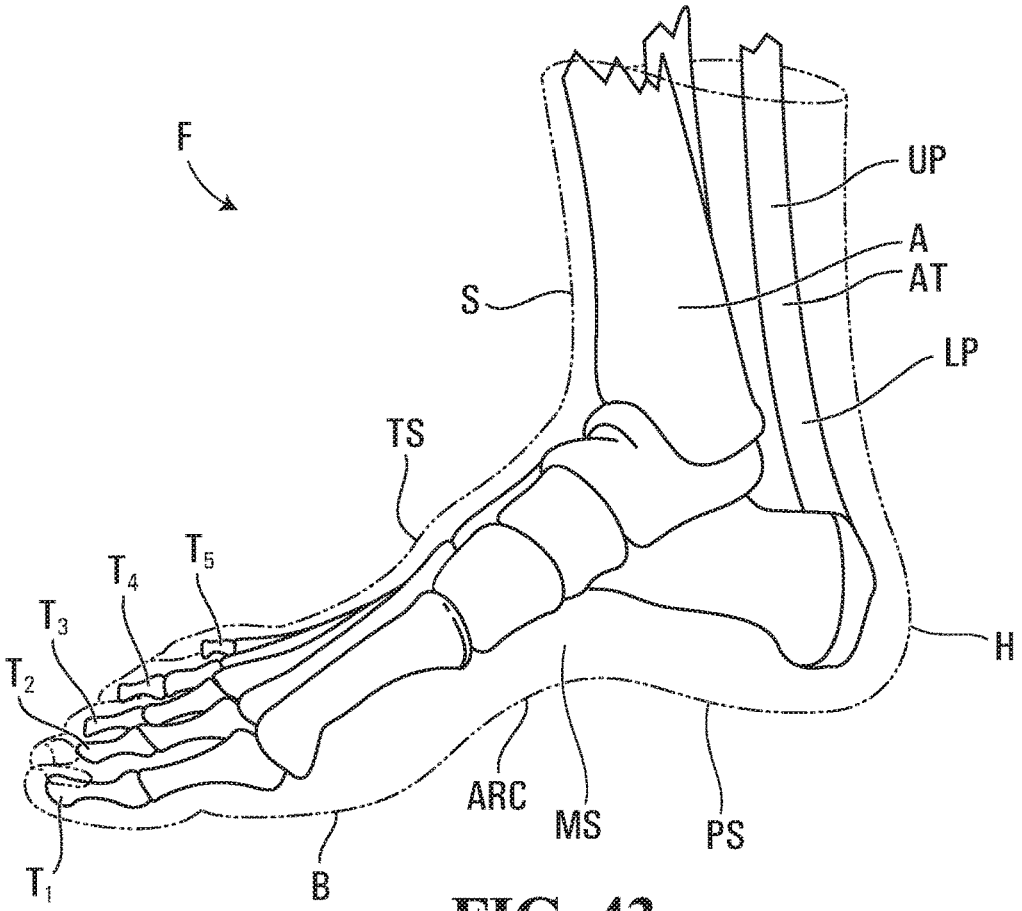
FIGS. 43 and 44 are side and front views of a right foot of the user with an integument of the foot shown in dotted lines and bones shown in solid lines.
Figure 44:
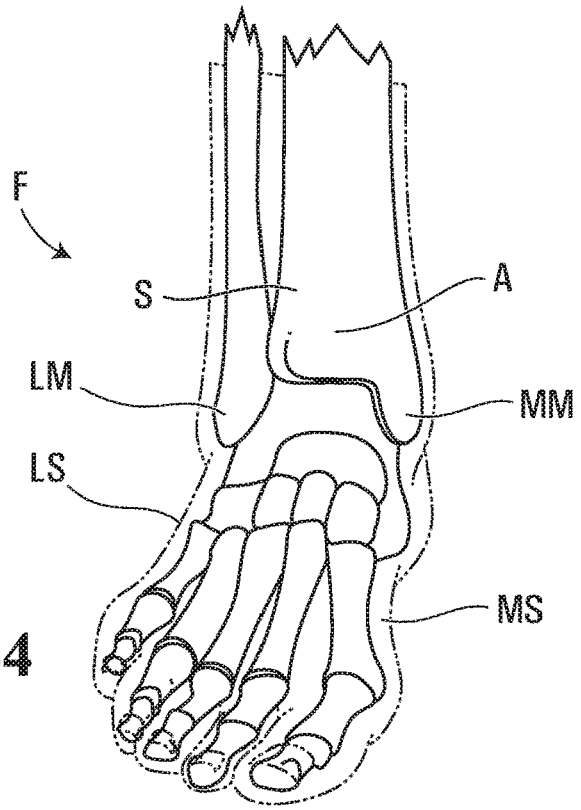

The skate boot 22 defines a cavity 54 for receiving the player's foot 11. With additional reference to FIGS. 43 and 44, the player's foot 11 comprises toes T, a ball B, an arch ARC, a plantar surface PS, a top surface TS including an instep IN, a medial side MS, a lateral side LS, and a heel HL. The top surface TS of the player's foot 11 is continuous with a lower portion of a shin S of the player. In addition, the player has an Achilles tendon AT and an ankle A having a medial malleolus MM and a lateral malleolus LM that is at a lower position than the medial malleolus MM. The Achilles tendon AT has an upper part UP and a lower part LP projecting outwardly with relation to the upper part UP and merging with the heel HL. A forefoot of the player includes the toes T and the ball B, a hindfoot of the player includes the heel HL, and a midfoot of the player is between the forefoot and the hindfoot.

More particularly, the skate boot 22 comprises a heel portion 21 configured to face the heel HL of the player's foot, an ankle portion 23 configured to face the ankle A of the player, a medial side portion 25 configured to face the medial side MS of the player's foot, a lateral side portion 27 configured to face the lateral side LS of the player's foot, an instep portion 41 configured to face the instep IN of the player's foot, a sole portion 29 configured to face the plantar surface PS of the player's foot, a toe portion 19 configured to receive the toes T of the user's foot, and a tendon guard portion 20 configured to face the upper part UP of the Achilles tendon AT of the player. The skate boot 22 has a longitudinal direction, a widthwise direction, and a heightwise direction.

In this embodiment, with additional reference to FIGS. 1 to 7, the skate boot 22 comprises a body 30 and a plurality of components connected to the body 30, which, in this example, includes facings $\mathbf{31}_1$, $\mathbf{31}_2$, a toe cap 14, a tongue 34, a liner 36, an insole 18, a footbed 38, and an outsole 39. Lacing holes $\mathbf{45}_1$-$\mathbf{45}_L$ extend through each of the facings $\mathbf{31}_1$, $\mathbf{31}_2$, the body 30, and the liner 36 to receive a lace 47 for securing the skate 10 to the player's foot. In this example, the eyelets $\mathbf{46}_1$-$\mathbf{46}_E$ are provided in respective ones of the lacing holes $\mathbf{45}_1$-$\mathbf{45}_L$ to engage the lace 47.

The body 30 of the skate boot 22, which may sometimes be referred to as a "shell", imparts strength and structural integrity to the skate 10 to support the player's foot. In this embodiment, the body 30 comprises medial and lateral side portions 66, 68 respectively configured to face the medial and lateral sides MS, LS of the player's foot, an ankle portion 64 configured to face the ankle A of the player, and a heel portion 62 configured to face the heel HL of the player. The medial and lateral side portions 66, 68, the ankle portion 64, and the heel portion 62 of the body 30 respectively constitute at least part (i.e., part or an entirety) of the medial and lateral side portions 25, 27, the ankle portion 23, and the heel portion 21 of the skate boot 22. The body 30 thus includes a quarter 75 which comprises a medial quarter part 77, a lateral quarter part 79, and a heel quarter 81. The heel portion 62 may be formed such that it is substantially cup-shaped for following a contour of the heel HL of the player. The ankle portion 64 comprises medial and lateral ankle sides 74, 76. The medial ankle side 74 has a medial depression 78 for receiving the medial malleolus MM of the player and the lateral ankle side 76 has a lateral depression 80 for receiving the lateral malleolus LM of the player. The lateral depression 80 is located slightly lower than the medial depression 78 for conforming to the morphology of the player's foot. In this example, the body 30 also comprises a sole portion 69 configured to face the plantar surface PS of the player's foot and a tendon guard portion 63 configured to face the upper part UP of the Achilles tendon AT of the player. The sole portion 69 and the tendon guard portion 63 of the body 30 respectively constitute at least part of the sole portion 29 and the tendon guard portion 20 of the skate boot 22.

In this embodiment, the body 30 of the skate boot 22 is molded to form its medial and lateral side portions 66, 68, its ankle portion 64, its heel portion 62, and its sole portion 69. For example, in some embodiments, the body 30 may be thermoformed (e.g., onto a male form, i.e., a last) to form its medial and lateral side portions 66, 68, its ankle portion 64, its heel portion 62, and its sole portion 69. As another example, in some embodiments, at least part of the body 30 may be injection molded such that two or more of its medial and lateral side portions 66, 68, its ankle portion 64, its heel portion 62, and its sole portion 69 are injection molded together and integral with one another (i.e., are injection molded together as a single piece). For instance, in some embodiments, the body 30 may be a monolithic body, i.e., a one-piece body, made by injection molding.

The body 30 of the skate boot 22 may include one or more materials making it up. For example, in some embodiments, the body 30 may include one or more polymeric materials, such as polyethylene, polypropylene, polyurethane (PU), ethylene-vinyl acetate (EVA), nylon, polyester, vinyl, polyvinyl chloride, polycarbonate, an ionomer resin (e.g., Surlyn®), styrene-butadiene copolymer (e.g., K-Resin®) etc.), and/or any other thermoplastic or thermosetting polymer. Alternatively or additionally, in some embodiments, the body 30 may include one or more composite materials, such as a fiber-matrix composite material comprising fibers disposed in a matrix. For instance, in some embodiments, the body 30 may include a fiber-reinforced plastic (FRP—a.k.a., fiber-reinforced polymer), comprising a polymeric matrix may include any suitable polymeric resin, such as a thermoplastic or thermosetting resin, like epoxy, polyethylene, polypropylene, acrylic, thermoplastic polyurethane (TPU), polyether ether ketone (PEEK) or other polyaryletherketone (PAEK), polyethylene terephthalate (PET), polyvinyl chloride (PVC), poly(methyl methacrylate) (PMMA), polycarbonate, acrylonitrile butadiene styrene (ABS), nylon, polyimide, polysulfone, polyamide-imide, self-reinforcing polyphenylene, polyester, vinyl ester, vinyl ether, polyurethane, cyanate ester, phenolic resin, etc., a hybrid thermosetting-thermoplastic resin, or any other suitable resin, and fibers such as carbon fibers, glass fibers, polymeric fibers such as aramid fibers (e.g., Kevlar fibers), boron fibers, silicon carbide fibers, metallic fibers, ceramic fibers, etc., which may be provided as layers of continuous fibers (e.g. pre-preg (i.e., pre-impregnated) layers of fibers held together by an amount of matrix). Another example of a composite material may be a self-reinforced polymeric (e.g., polypropylene) composite (e.g., a Curv® composite).

The toe cap 14 is configured to receive the toes T of the player's foot. It comprises a medial part 61 configured to receive a big toe of the player's toes T, a lateral part 63 configured to receive a little toe of the player's toes T, and an intermediate part 65 that is between its medial part 61 and its lateral part 63 and configured to receive index, middle and ring toes of the player's toes T. The toe cap 14 comprises a distal part 52 adjacent to distal ends of the toes T of the player's foot and a proximal part 44 adjacent to proximal ends of the toes T of the player's foot.

The toe cap 14 includes rigid material. For example, in some embodiments, the toe cap 14 may be made of nylon, polycarbonate, polyurethane, polyethylene (e.g., high density polyethylene), or any other suitable thermoplastic or thermosetting polymer. Alternatively or additionally, in some embodiments, the toe cap 14 may include composite material, such as a fiber-matrix composite material comprising fibers disposed in a matrix. For instance, in some embodiments, the toe cap 14 may include a fiber-reinforced plastic (FRP—a.k.a., fiber-reinforced polymer), comprising a polymeric matrix may include any suitable polymeric resin, such as a thermoplastic or thermosetting resin, like epoxy, polyethylene, polypropylene, acrylic, thermoplastic polyurethane (TPU), polyether ether ketone (PEEK) or other polyaryletherketone (PAEK), polyethylene terephthalate (PET), polyvinyl chloride (PVC), poly(methyl methacrylate) (PMMA), polycarbonate, acrylonitrile butadiene styrene (ABS), nylon, polyimide, polysulfone, polyamide-imide, self-reinforcing polyphenylene, polyester, vinyl ester, vinyl ether, polyurethane, cyanate ester, phenolic resin, etc., a hybrid thermosetting-thermoplastic resin, or any other suitable resin, and fibers such as carbon fibers, glass fibers, polymeric fibers such as aramid fibers (e.g., Kevlar fibers), boron fibers, silicon carbide fibers, metallic fibers, ceramic fibers, etc., which may be provided as layers of continuous fibers (e.g. pre-preg (i.e., pre-impregnated) layers of fibers held together by an amount of matrix).

In this embodiment, the toe cap 14 is molded such that a shape of the toe cap 14 is imparted during a molding process in a mold. For instance, in some embodiments, the toe cap 14 may be injection molded. In other embodiments, such as where the toe cap 14 comprises composite material, any other suitable molding (e.g., compression molding) process may be used.

The facings $\mathbf{31}_1$, $\mathbf{31}_2$ are provided on the medial and lateral side portions 66, 68 of the body 30 of the skate boot 22, including on an external surface 67 of the body 30. In this embodiment, the facings $\mathbf{31}_1$, $\mathbf{31}_2$ extend respectively along medial and lateral edges $\mathbf{32}_1$, $\mathbf{32}_2$ of the body 30 from the ankle portion 64 to the medial and lateral side portions 66, 68 towards the toe cap 14.

Figure 8:
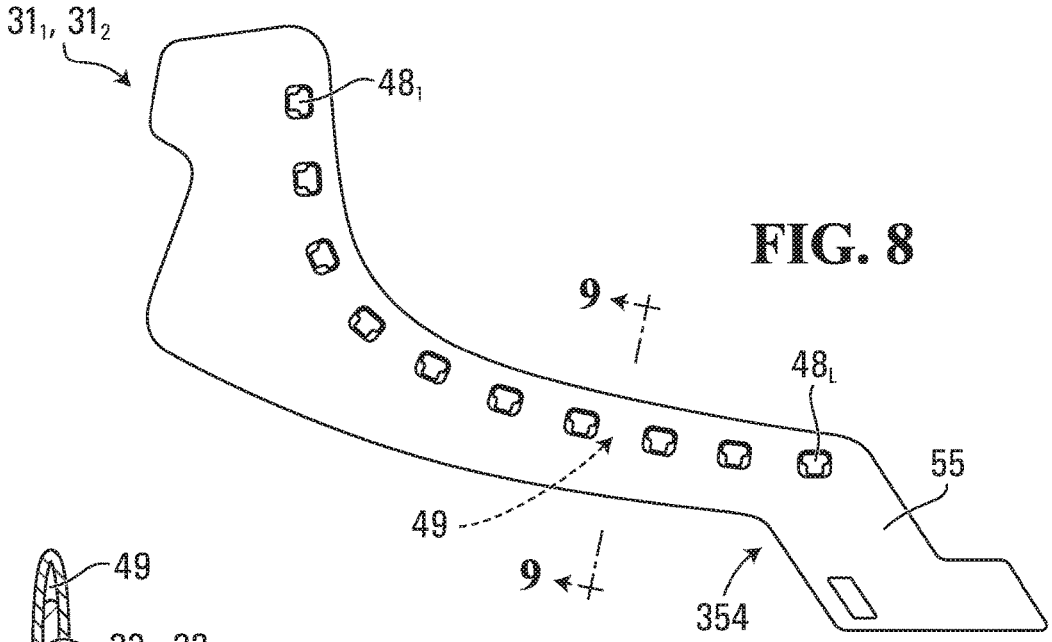
FIG. 8 shows a facing of the skate boot.
Figure 9:
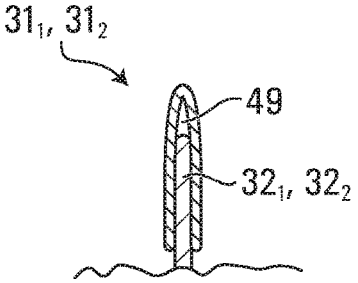
FIG. 9 shows a cross-sectional view of the facing taken along line 9-9 of FIG. 8.

With additional reference in FIGS. 8 and 9, each of the facings $\mathbf{31}_1$, $\mathbf{31}_2$ comprises lacing openings $\mathbf{48}_1$-$\mathbf{48}_L$ that are part of respective ones of the lacing holes $\mathbf{45}_1$-$\mathbf{45}_L$ to receive the lace 47. In that sense, the facings $\mathbf{31}_1$, $\mathbf{31}_2$ may be viewed as lacing members. In this example, each of the facings $\mathbf{31}_1$, $\mathbf{31}_2$ includes a void 49 to receive a given one of the medial and lateral edges $\mathbf{32}_1$, $\mathbf{32}_2$ of the body 30 that it straddles and that includes lacing openings $\mathbf{50}_1$-$\mathbf{50}_L$ which are part of respective ones of the lacing holes $\mathbf{45}_1$-$\mathbf{45}_L$ to receive the lace 47.

In this embodiment, each of the facings $\mathbf{31}_1$, $\mathbf{31}_2$ is molded such that a shape of that facing is imparted during a molding process in a mold. More particularly, in this embodiment, each of the facings $\mathbf{31}_1$, $\mathbf{31}_2$ is injection molded. For example, each of the facings $\mathbf{31}_1$, $\mathbf{31}_2$ may be made from nylon or any other suitable polymeric material, such as thermoplastic polyurethane (TPU), polyvinyl chloride (PVC), or any other thermoplastic or thermosetting polymer.

In other embodiments, the facings $\mathbf{31}_1$, $\mathbf{31}_2$ may be manufactured in any other suitable way (e.g., cut, stamped, etc.) and/or include any other suitable material (e.g., leather, any synthetic material that resembles leather, and/or any other suitable material).

The facings $\mathbf{31}_1$, $\mathbf{31}_2$ may be connected to the body 30 of the skate boot 22 in any suitable way. For instance, in some embodiments, each of the facings $\mathbf{31}_1$, $\mathbf{31}_2$ may be fastened to the body 30 (e.g., via stitching, staples, etc.), glued or otherwise adhesively bonded to the body 30 via an adhesive, or ultrasonically bonded to the body 30.

In this embodiment, each of the facings $\mathbf{31}_1$, $\mathbf{31}_2$ overlaps and is secured to the toe cap 14 (e.g., by one or more fasteners such as a mechanical fastener, like a rivet, a tack, a screw, a nail, stitching, or any other mechanical fastening device, or an adhesive). This may enhance solidity, integrity and durability of the skate boot 22 proximate to the toe cap 14 and/or may facilitate manufacturing of the skate boot 22. More particularly, in this embodiment, the facing $\mathbf{31}_1$ overlaps and is secured to the medial side portion 61 of the toe cap 14 while the facing $\mathbf{31}_2$ overlaps and is secured to the lateral side portion 63 of the toe cap 14.

The liner 36 of the skate boot 22 is affixed to an inner surface 37 of the body 30 and comprises an inner surface 96 for facing the heel HL and medial and lateral sides MS, LS of the player's foot 11 and ankle A. The liner 36 may be affixed to the body 30 by stitching or stapling the liner 36 to the body 30, gluing with an adhesive and/or any other suitable technique. The liner 36 may be made of a soft material (e.g., a fabric made of NYLON® fibers, polyester fibers or any other suitable fabric). The footbed 38 may include a foam layer, which may be made of a polymeric material. For example, the footbed 38, in some embodiments, may include a foam-backed fabric. The footbed 38 is mounted inside the body 30 and comprises an upper surface 106 for receiving the plantar surface PS of the player's foot 11. In this embodiment, the footbed 38 affixed to the sole portion 69 of the body 30 by an adhesive and/or any other suitable technique. In other embodiments, the footbed 38 may be removable. In some embodiments, the footbed 38 may also comprise a wall projecting upwardly from the upper surface 106 to partially cup the heel HL and extend up to a medial line of the player's foot 11.

Figure 10:
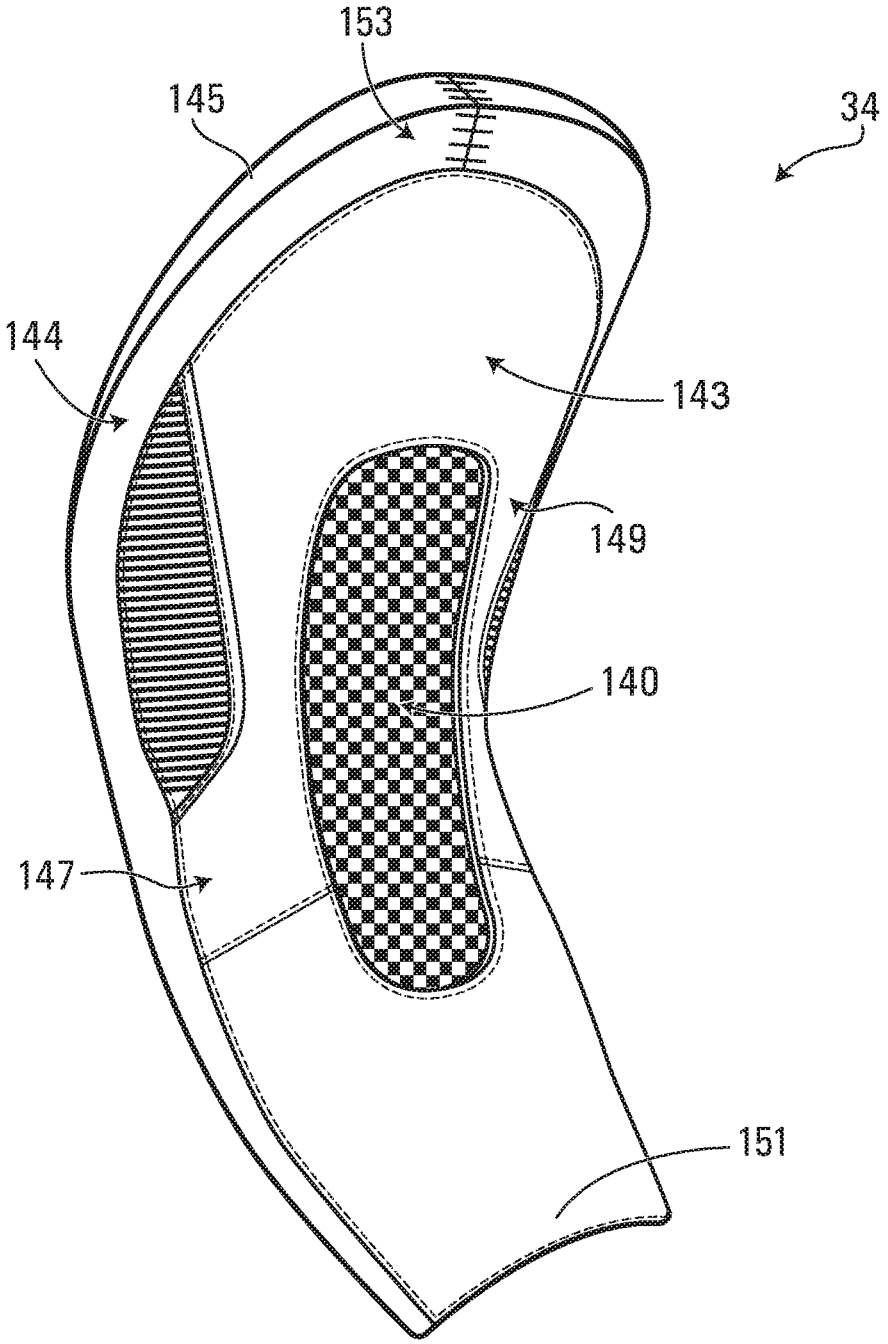
FIG. 10 is a perspective view of a tongue of the skate boot.

The tongue 34 extends upwardly and rearwardly from the toe portion 19 of the skate boot 22 for overlapping the top surface TS of the player's foot 11. In this embodiment, the tongue 34 is affixed to the body 30. In particular, in this embodiment, the tongue 34 is fastened to the toe cap 14. With additional reference to FIG. 10, in some embodiments, the tongue 34 comprises a core 140 defining a section of the tongue 34 with increased rigidity, a padding member (not shown) for absorbing impacts to the tongue 34, a peripheral member 94 for at least partially defining a periphery 95 of the tongue 34, and a cover member 143 configured to at least partially define a front surface of the tongue 34. The tongue 34 defines a lateral portion 147 overlying a lateral portion of the player's foot 11 and a medial portion 149 overlying a medial portion of the player's foot 11. The tongue 34 also defines a distal end portion 151 for affixing to the toe cap 14 (e.g., via stitching, riveting, welding (e.g. high-frequency welding), bonding) and a proximal end portion 153 that is nearest to the player's shin S. The core 140 may be made of foam or similar materials to that of the body 30 and may be formed by injection molding in a similar manner to that of the body 30, as described herein.

With additional reference to FIGS. 11 to 13, the protector 16 is designed to be secured over the skate boot 22 for protecting the skate boot 22 and the user's foot against impacts, such as from pucks, which may occur during shots. To that end, in this embodiment, the protector 16 comprises a cover 18 configured to cover at least part of the skate boot 22 and provide impact protection and a fastening system 32 configured to fasten the protector 16 to the skate 10. In this example, the protector 16 allows the user to don and doff the skate 10 while the fastening system 32 fastens the protector 16 to the skate 10, which facilitates its use, and emulates an appearance of an exterior 39 of the skate boot 22, such that it can be as unnoticeable as possible.

The cover 18 is a body of the protector 16 that provides impact protection. In this embodiment, the cover 18 is configured to cover at least part (e.g., a majority) of the lateral side portion 27 of the skate boot 22, at least part (e.g., a majority) of the medial side portion 25 of the skate boot 22, at least part (e.g., a majority) of the ankle portion 23 of the skate boot 22, and at least part (e.g., a majority) of the heel portion 21 of the skate boot 22.

In this embodiment, the cover 18 is configured to define an opening 59 over the instep portion 41 of the skate boot 22 such that the cover 18 leaves the instep portion 41 of the skate boot 22 exposed, i.e., uncovered by the cover 18. Also, in this embodiment, the opening 59 defined by the cover 18 extends over the tongue 34 such that the cover 18 leaves the tongue 34 exposed where the tongue 34 faces the instep IN of the user's foot 11. As such, the cover 18 is configured to cover at least part of the skate boot 22 without extending over the top surface TS of the user's foot.

As shown in FIGS. 14 to 18, the cover 18 of the protector 16 includes an inner side 128 configured to face and engage the skate boot 22, and an outer side 126 configured to face away from the skate boot 22. The inner side 128 of the cover 18 of the foot protector 16 may be configured to match at least part of the exterior 39 of the skate boot 22 such that the foot protector 16 substantially conforms to the skate boot 22. In this example, in order to do so, the cover 18 is shaped during original manufacturing of the protector 16 to conform to the external surface 67 of the body 30 of the skate boot 22.

For instance, the external surface 67 of the skate boot 22 may comprise projections $\mathbf{71}_1$-$\mathbf{71}_P$ and recesses $\mathbf{73}_1$-$\mathbf{73}_R$ and the cover 18 may comprise corresponding projections $\mathbf{83}_1$-$\mathbf{83}_P$ and recesses $\mathbf{85}_1$-$\mathbf{85}_R$ configured to register with respective ones of the projections $\mathbf{71}_1$-$\mathbf{71}_P$ and recesses $\mathbf{73}_1$-$\mathbf{73}_R$ of the external surface 67 of the skate boot 22. More specifically, in this embodiment, the projections $\mathbf{71}_1$-$\mathbf{71}_P$ of the skate boot 22 include a medial malleolus projection $\mathbf{71}_1$ configured to face the medial malleolus MM of the user and a lateral malleolus projection $\mathbf{71}_2$ configured to face the lateral malleolus LM of the user, whereas the corresponding projections $\mathbf{83}_1$-$\mathbf{83}_P$ and recesses $\mathbf{85}_1$-$\mathbf{85}_R$ of the cover 18 include: a medial malleolus projection $\mathbf{83}_1$ and a medial malleolus recess $\mathbf{85}_1$ configured to register with the medial malleolus projection $\mathbf{71}_1$ of the skate boot 22, with the medial malleolus recess $\mathbf{85}_1$ on the inner side 128 of the cover 18 to receive the medial malleolus projection $\mathbf{71}_1$ of the skate boot 22 and the medial malleolus projection $\mathbf{83}_1$ on the outer side 126 of the cover 18; and a lateral malleolus projection $\mathbf{83}_2$ and a lateral malleolus recess $\mathbf{85}_2$ configured to register with the lateral malleolus projection $\mathbf{71}_2$ of the skate boot 22, with the lateral malleolus recess $\mathbf{85}_2$ on the inner side 128 of the cover 18 to receive the lateral malleolus projection $\mathbf{71}_2$ of the skate boot 22 and the lateral malleolus projection $\mathbf{83}_2$ on the outer side 126 of the cover 18. In some embodiments, the projections $\mathbf{71}_1$-$\mathbf{71}_P$ of the skate boot 22 may also include elongate reinforcing projections $\mathbf{71}_3$-$\mathbf{71}_6$ (e.g., ribs) and the corresponding projections $\mathbf{83}_1$-$\mathbf{83}_P$ and recesses $\mathbf{85}_1$-$\mathbf{85}_R$ of the cover 18 include elongate projections $\mathbf{83}_3$-$\mathbf{83}_6$ and elongate recesses $\mathbf{85}_3$-$\mathbf{85}_6$ configured to register with the elongate reinforcing projections $\mathbf{71}_3$-$\mathbf{71}_6$ of the skate boot 22, with the elongate recesses $\mathbf{85}_3$-$\mathbf{85}_6$ on the inner side 128 of the cover 18 to receive the elongate reinforcing projections $\mathbf{71}_3$-$\mathbf{71}_6$ of the skate boot 22 and the elongate projections $\mathbf{83}_3$-$\mathbf{83}_6$ on the outer side 126 of the cover 18.

In this embodiment, the cover 18 of the foot protector 16 comprises a lateral wall 112, a medial wall 114 and a heel wall 116 that are respectively configured to overlie and cover at least part (e.g., a majority) of the medial side portion 25, the lateral side portion 27 and the heel portion 21 of the skate boot 22. The heel wall 116 may be shorter than each of the lateral wall 112 and the medial wall 114 in a heightwise direction of the protector 16. In this example, the walls 112, 114, 116 of the cover 18 are integrally formed one with another, i.e., form a unitary structure. In this case, the walls 112, 114, 116 are molded integrally with one another.

The cover 18 of the foot protector 16 may comprise a plurality of layers that include a plurality of materials different from one another. For instance, an inner one of the layers of the cover 18 may be softer than an outer one of the layers of the cover 18. For example, a first one of the layers of the cover may comprise foam and a second one of the layers of the cover may comprise a non-foam material In this embodiment, each of the walls 112, 114, 116 of the cover 18 comprises an outer layer 132 configured for enhancing impact protection (e.g. by having a high stiffness). In this example, the outer layer 132 may enhance impact protection by facilitating dispersion of the energy of impacts over a relatively large surface. For instance, outer layer 132 may comprise a material 166 that has mechanical properties to enhance impact protection (e.g., high rigidity and high resilience).

Additionally, the material 166 may impart aesthetic features to the cover 16. For instance, at least part of the cover 16 may be opaque. More specifically, in this case, at least a majority (i.e., a majority or an entirety) of the cover 18 is opaque.

In this example, the material 166 may be a self-reinforced polymeric material (e.g., polypropylene tapes in a polypropylene matrix such as commercialized as Curv™ material). In other examples, the material 166 is composite material, namely a fiber-reinforced polymeric material (e.g., carbon composite).

Each of the walls 112, 114, 116 may also comprise an inner layer 134 comprising a material 168 which has mechanical properties to enhance impact protection. In this example, the inner layer 134 may enhance impact protection by facilitating shock absorption, i.e. by facilitating the absorption of the energy of the impact. In this embodiment, the material 168 of the inner layer 134 is less rigid than the material 166 of the outer layer 132. In this case, the material 168 is an extended polymer material (e.g. a foam). When an impact occurs, for example when a puck hits the foot protector 16, the material 166 of the outer layer 132 may allow the outer layer 132 to disperse energy of the impact (e.g. over an area of the protector 16), while the material 168 of the inner layer 134 may allow the inner layer 134 to absorb the energy of the impact. In this context, in some embodiments, a thickness of the inner layer 134 is greater than a thickness of the outer layer 132. For instance, in some embodiments, a ratio of the thickness of the inner layer 134 over the thickness of the outer layer 132 may be at least 1.1, in some embodiments at least 1.5, at in some embodiments least 2, in some embodiments at least 3, in some embodiments at least 4, and in some embodiments even more.

In some cases, at least one of the layers 132, 134 may dissipate energy of the impact by failure. However, in this case, the protector 16 may become less efficient after one significant impact is absorbed.

The layers 132, 134 of the cover 18 may be held together by any suitable means. For instance, in this embodiment, the layers 132, 134 are fastened to one another by a fastener. In this embodiment, the fastener is an adhesive and the layers 132, 134 are held together being adhesively bonded to one another. In other embodiments, the fastener may be of any suitable kind and may be, for example, a mechanical fastener (e.g. a rivet, a stitch).

In some embodiments, the walls 112, 114, 116 may comprise one or more other layers and/or one or more other materials.

In this embodiment, the fastening system 32 of the protector 16 comprises a plurality of lacing openings $\mathbf{140}_1$-$\mathbf{140}_4$ configured to receive the lace 47. The lacing openings $\mathbf{140}_1$-$\mathbf{140}_4$ are configured to be aligned with the lacing openings $\mathbf{45}_1$-$\mathbf{45}_L$ of the skate boot 22. In this example, respective ones of the lacing openings $\mathbf{140}_1$-$\mathbf{140}_4$ of the fastening system 32 extend through the medial wall 114 and the lateral wall 116 of the cover 18.

In this example, the fastening system 32 comprises a plurality of eyelets $\mathbf{142}_1$, $\mathbf{142}_2$, $\mathbf{144}_1$, $\mathbf{144}_2$ about the lacing openings $\mathbf{140}_1$-$\mathbf{140}_4$ of the fastening system 32, and a plurality of reinforcing members $\mathbf{146}_1$-$\mathbf{146}_4$ disposed about the lacing openings $\mathbf{140}_1$-$\mathbf{140}_4$ of the fastening system 32 and overlying the cover 18 to protect the lace 47 from sharp edges of the cover 18 causing premature wear and/or to protect the cover 18 from premature wear.

More specifically, in this embodiment, the fastening system 32 comprises lateral eyelets $\mathbf{142}_1$, $\mathbf{142}_2$ and medial eyelets $\mathbf{144}_1$, $\mathbf{144}_2$ configured to match respective eyelets $\mathbf{46}_i$-$\mathbf{46}_k$ of the skate boot 22 and to allow the foot protector 16 to be fastened to the skate boot 22 with the lace 47 passing through them and through these eyelets $\mathbf{46}_i$-$\mathbf{46}_k$ of the skate book 22. Each of the eyelets $\mathbf{142}_1$, $\mathbf{142}_2$, $\mathbf{144}_1$, $\mathbf{144}_2$ may go through one of the walls 112, 114 of the cover 18. The reinforcement members $\mathbf{146}_1$-$\mathbf{146}_4$ may be added to the outer side 126 and to the inner side 128 of the cover 18, covering an area 148 around each of the eyelets $\mathbf{142}_1$, $\mathbf{142}_2$, $\mathbf{144}_1$, $\mathbf{144}_2$. In this case, the reinforcement members $\mathbf{146}_1$-$\mathbf{146}_4$ is made of made from sheets of rubber material which are glued and stitched to the outer layer 132 of the cover 18. In other embodiments, the reinforcement member $\mathbf{146}_1$-$\mathbf{146}_4$ may comprise other polymeric materials such as kevlar, a resin and/or a composite material and may be provided and applied to the cover 18 by any suitable way.

Figure 19:
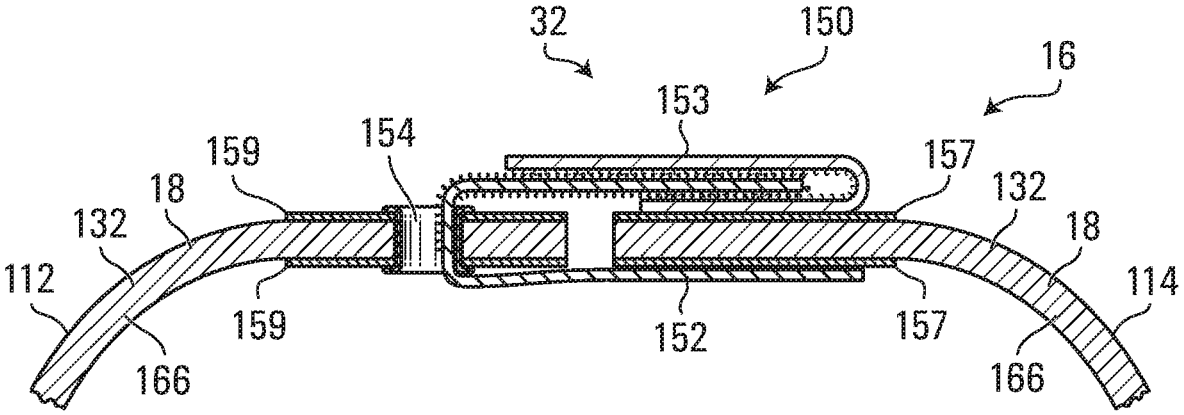
FIG. 19 is a cross-sectional view of the protector at a plantar fastener of the protector.
Figure 20:
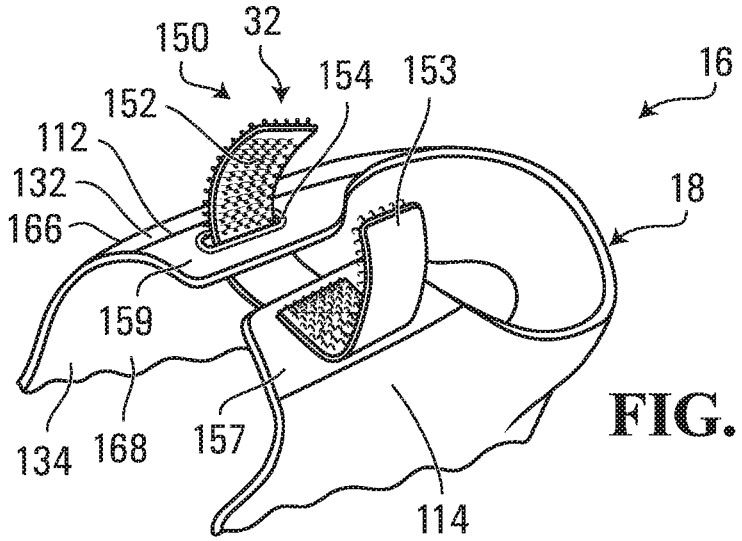
FIGS. 20 and 21 show operational modes of the plantar fastener of the protector.
Figure 21:
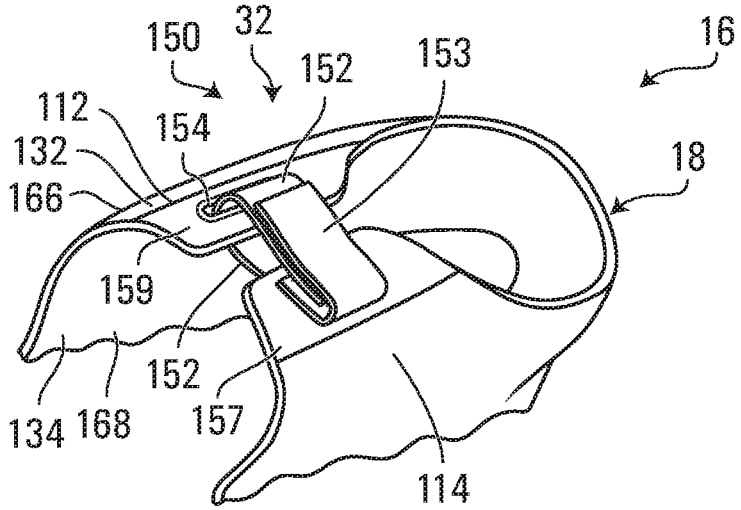

The fastening system 32 also comprises a plantar fastener 150 configured to be disposed under the skate boot 22, and reinforcements layers 157, 159 affixed to the cover 18, as shown in FIGS. 19 to 21. More particularly, in this embodiment, the plantar fastener 150 is a hook-and-loop (e.g., Velcro) fastener. The hook-and-loop fastener 150 fastens the protector 16 under the skate boot 22 and through a void of the blade holder 24. The hook-and-loop fastener 150 comprises a hook-and-loop strap 152 attached to the medial wall 114 of the foot protector 16 and a strap-receiving opening 154 on the outer wall 112 of the protector 16.

Figure 22:
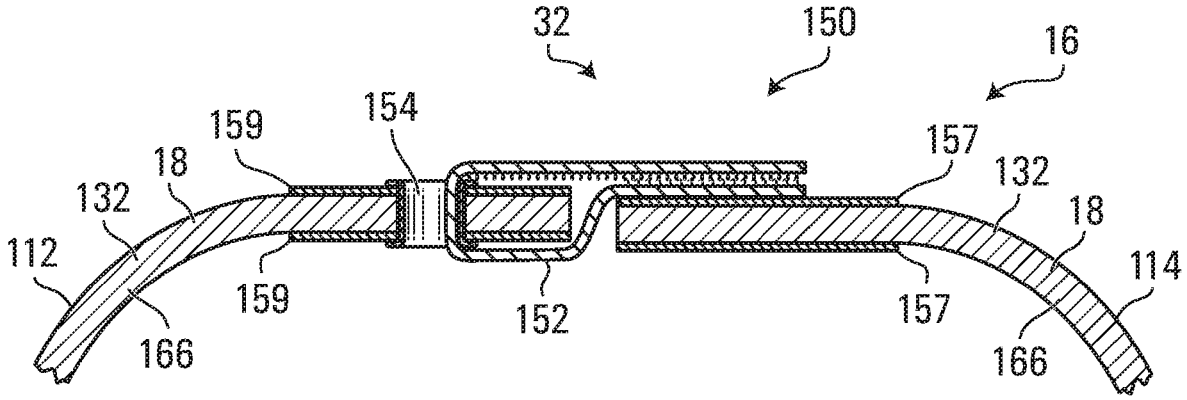
FIG. 22 is a cross-sectional view of the protector with a variant of the plantar fastener.

The hook-and-loop strap 152 may be of any suitable kind and configured in any suitable way. For instance, in this embodiment, the hook-and-loop strap 152 offers a locking effect and may be locked by a second hook-and-loop strap 153 in a closed position, as shown in FIGS. 19 to 21, in order to secure the protector 16 more efficiently about the skate 10. In another embodiment, the hook-and-loop strap 152 may be in a traditional singular configuration, i.e. may not be additionally secured by another hook-and-loop strap, as shown in FIG. 22.

The hook-and-loop strap 152 and reinforcement layers 157 of the fastening system 32 and the cover 18 may be held together by any suitable means. For instance, in this embodiment, the hook-and-loop strap 152 and reinforcement layers 157 of the fastening system 32 and the cover 18 are fastened to one another by a fastener. The fastener may be of any suitable kind and may be, for example, a mechanical fastener (e.g. a rivet) or glue. In this embodiment, the hook-and-loop strap 152 is adhesively bonded and stitched to the reinforcement layers 157 which are all attached to the medial wall 114 of the cover 18 by being adhesively bonded and stitched to the outer layer 132 of the medial wall 114.

In this embodiment, the strap-receiving opening 154 is configured to allow the hook-and-loop strap 152 to pass therethrough in order to close upon itself. The strap-receiving opening 154 is affixed to reinforcement layers 159 and to the lateral wall 112 by mechanical interlock as it is pressed through the reinforcement layers 159 and through the outer layer 132 of the lateral wall 112. The reinforcement layers 159 are attached to the lateral wall 112 by being adhesively bonded and stitched to the outer layer 132 of the lateral wall 112.

The reinforcement layers 157, 159 may be made in any suitable way in order to provide light weight and durability to the plantar fastener 150. For instance, in this embodiment, the reinforcement layers 157, 159, are made of made from sheets of rubber material which are adhesively bonded and stitched to the outer layer 132 of the cover 18. In other embodiments, the reinforcement layers 157, 159 may comprise other polymeric materials such as kevlar, a resin and/or a composite material and may be provided and applied to the cover 18 by any suitable way.

Figure 23A:
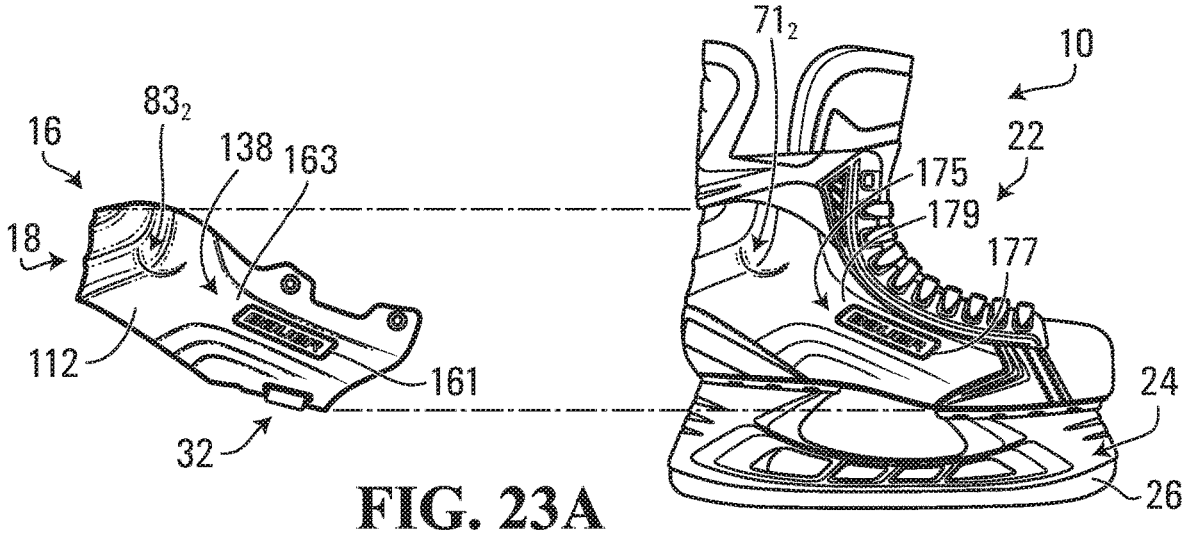
FIGS. 23A to 23C are lateral side views of variants of the protector and the skate.
Figure 23B:
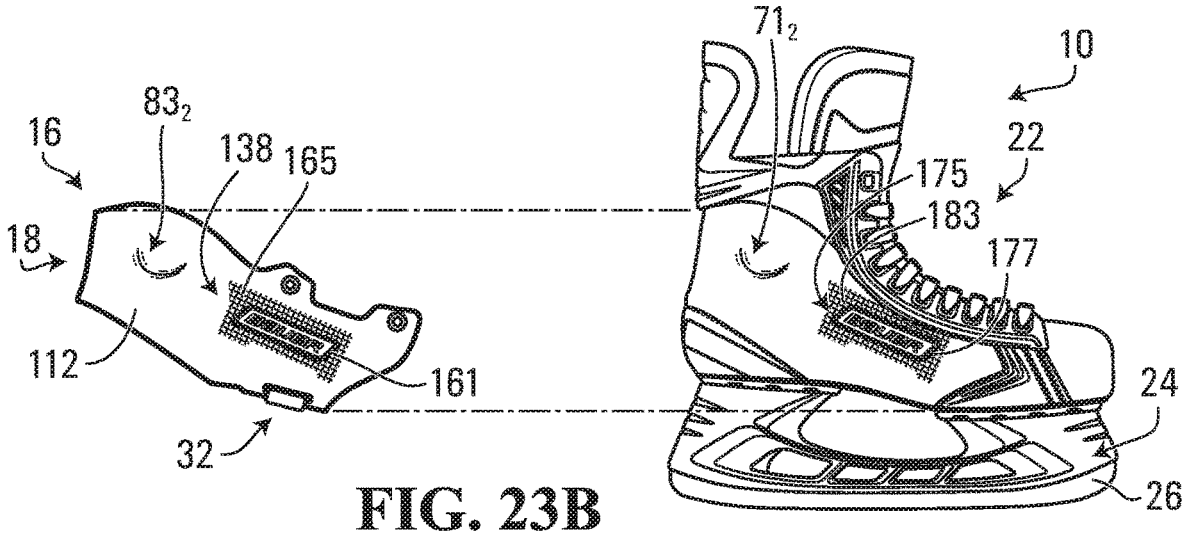
Figure 23C:
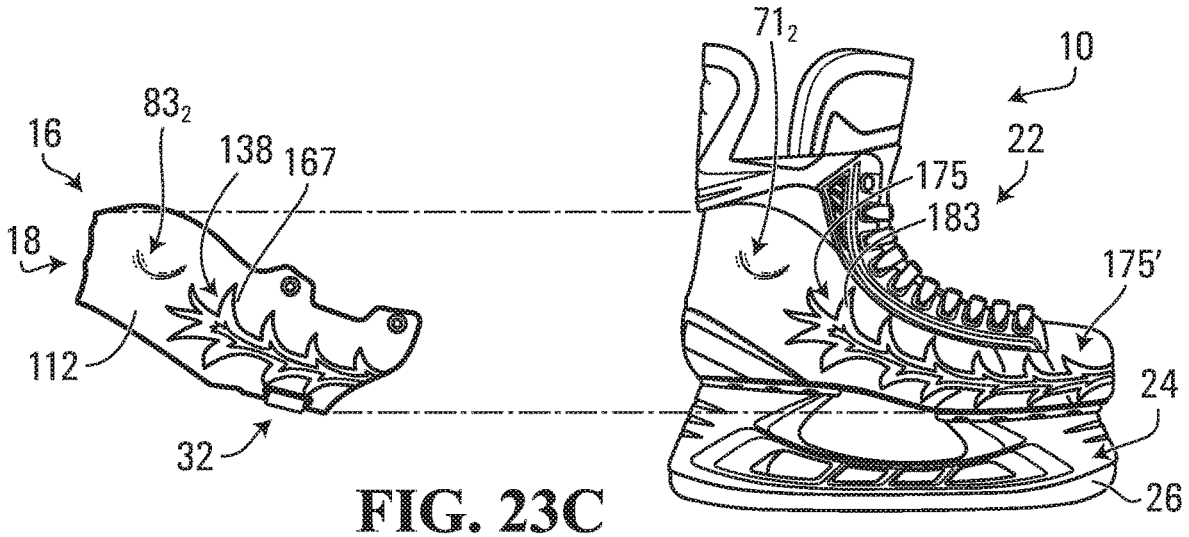

With additional reference to FIGS. 23A to 23C, in this embodiment, an appearance of the outer side 126 of the cover 18 may be configured to emulate an appearance of an exterior 39 of the skate boot 22. For instance, in some cases, the outer side 126 of the cover 18 includes a graphic, a color, a pattern and/or a logo configured to emulate a graphic, a color, a pattern and/or a logo of the exterior 39 of the skate boot 22. For example, the outer side 126 of each of the walls 112, 114 of the cover 18 may comprise a logo 161 that can correspond to a similar logo 177 on the skate boot 22 (e.g., so as to maintain brand visibility). The logo 161 can be printed, painted, etc. In this case, the logo 161 is part of a layer that is glued and stitched to the walls 112, 114. As another example, a color 163 of a part 138 of the cover 18 may correspond (i.e., match) with a color 179 of a part 175 of the skate boot 22 that underlies the part 138 of the cover 18. As another example, in a similar fashion, a pattern 165 of the part 138 of the cover 18 may corresponds with a pattern 181 of the part 175 of the skate boot 22 that underlies the part 138 of the cover 18. As another example, in a similar fashion, a graphic 167 of the part 138 of the cover 18 may corresponds with a graphic 183 of the part 175 of the skate boot 22 that underlies the part 138 of the cover 18. In this embodiment, when the graphic 183 of the skate boot 22 extends beyond the limits of the part 175 of the skate boot 22 that underlies the cover 18 (e.g., over a part 175' of the skate boot 22 that does not underlie the cover 18), the graphic 167 of the cover 18 may be continuous with the graphic 183 of the skate boot 22, i.e., the graphic 167 of the cover 22 may be continuous with a portion of the graphic 183 of the skate boot 22 that is beyond the cover 18.

In some embodiments, the appearance of the outer side 126 of the cover 18 may be configured to emulate the appearance of the exterior 39 of the skate boot 22 to such an extent that the cover creates confusion to an observer (e.g. another hockey player, a spectator, etc.) as to whether the skater wears the skate 10 with or without the protector 16.

Figure 24:
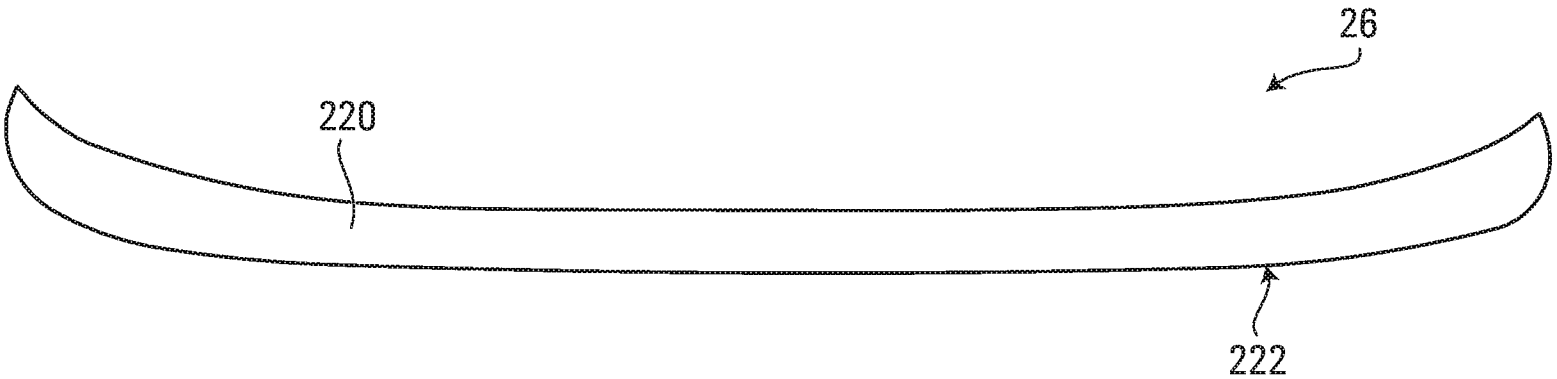
FIG. 24 is a side view of a blade of a skating device of the skate.

With additional reference to FIG. 24, the blade 26 comprises an ice-contacting material 220 including an ice-contacting surface 222 for sliding on the skating surface 12 while the player skates. In this embodiment, the ice-contacting material 220 is a metallic material (e.g., stainless steel). The ice-contacting material 220 may be any other suitable material in other embodiments.

Figure 25:
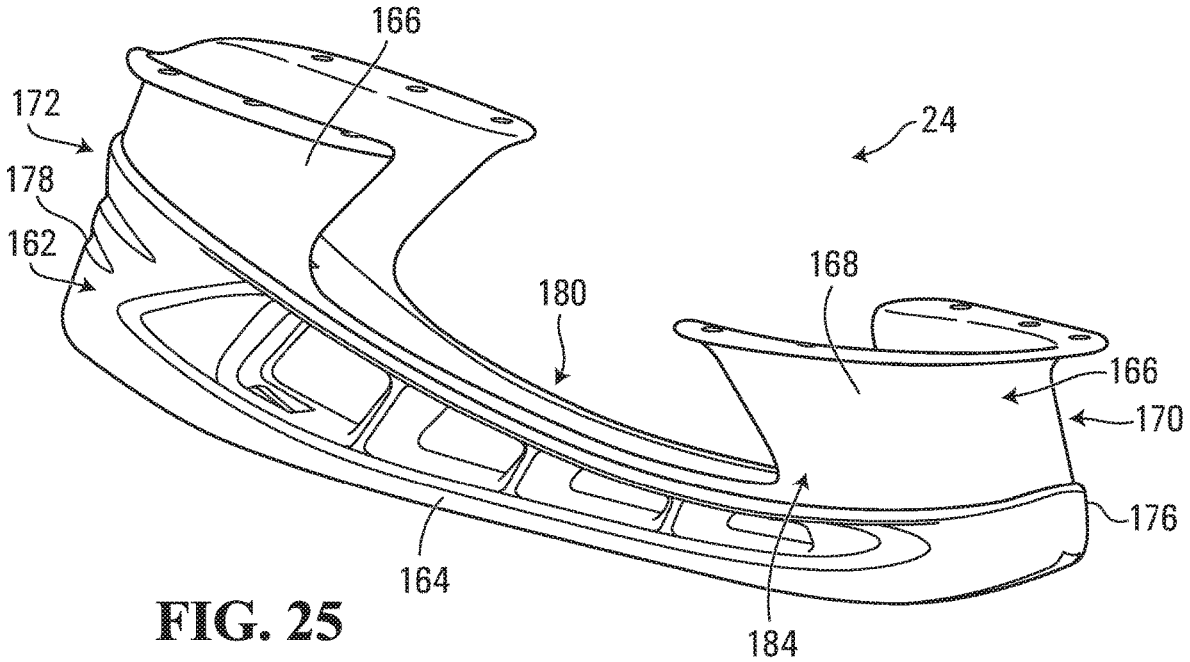
FIGS. 25 to 27 show views of a blade holder of the skate.
Figure 26:
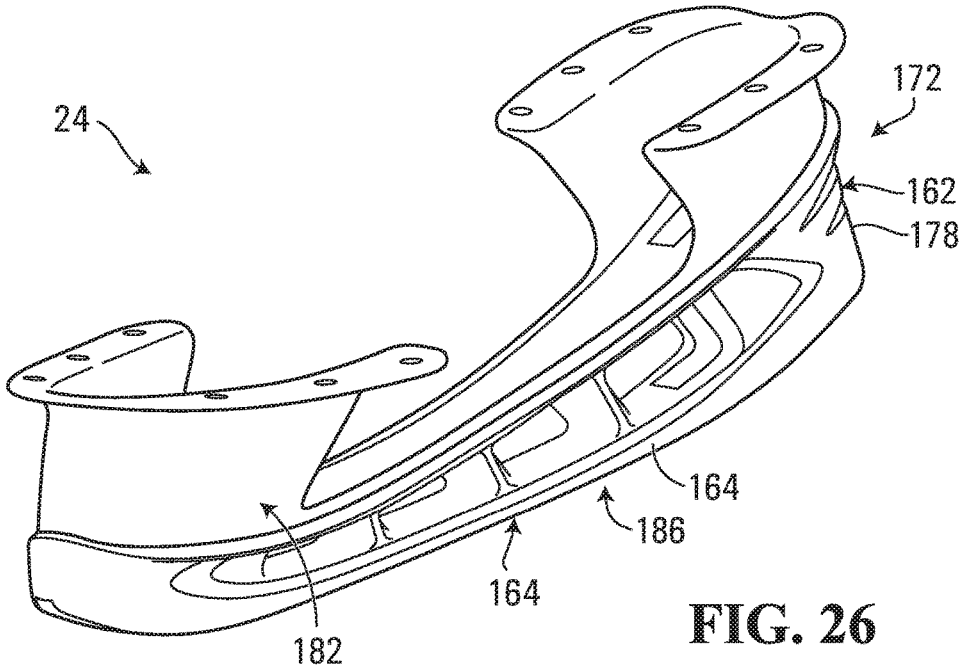
Figure 27:
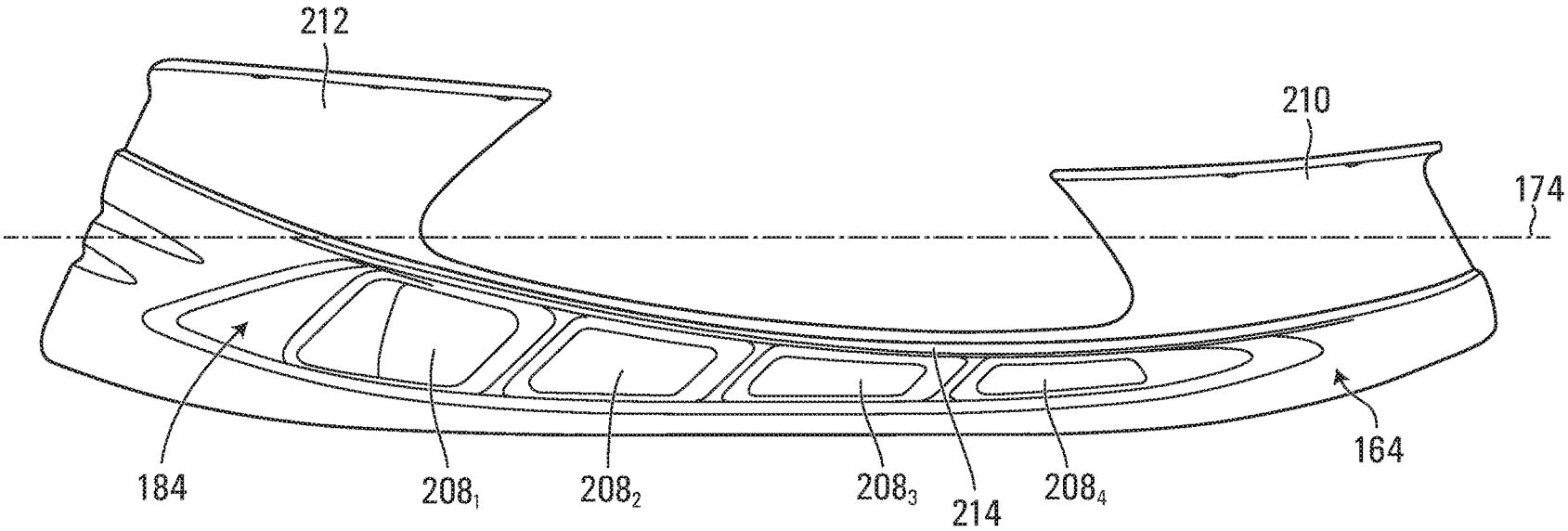

The blade holder 24 comprises a lower portion 162 comprising a blade-retaining base 164 that retains the blade 26 and an upper portion 166 comprising a support 168 that extends upwardly from the blade-retaining base 164 towards the skate boot 22 to interconnect the blade holder 24 and the skate boot 22, as shown in FIGS. 25 to 27. A front portion 170 of the blade holder 24 and a rear portion 172 of the blade holder 24 define a longitudinal axis 174 of the blade holder 24. The front portion 170 of the blade holder 24 includes a frontmost point 176 of the blade holder 24 and extends beneath and along the player's forefoot in use, while the rear portion 172 of the blade holder 24 includes a rearmost point 178 of the blade holder 24 and extends beneath and along the player's hindfoot in use. An intermediate portion 180 of the blade holder 24 is between the front and rear portions 170, 172 of the blade holder 24 and extends beneath and along the player's midfoot in use. The blade holder 24 comprises a medial side 182 and a lateral side 184 that are opposite one another.

Figure 28:
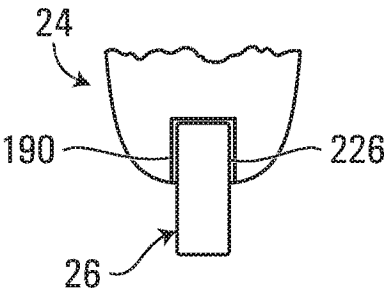
Figure 30:
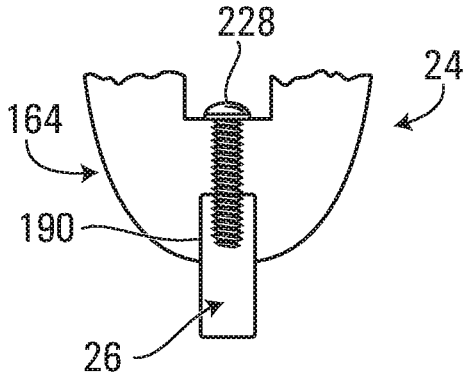

The blade-retaining base 164 is elongated in the longitudinal direction of the blade holder 24 and is configured to retain the blade 26 such that the blade 26 extends along a bottom portion 186 of the blade-retaining base 164 to contact the skating surface 12. To that end, the blade-retaining base 164 comprises a blade-retention portion 188 to face and retain the blade 26. In this embodiment, as shown in FIG. 28, the blade-retention portion 188 comprises a recess 190 in which an upper portion of the blade 26 is disposed.

Figure 29:
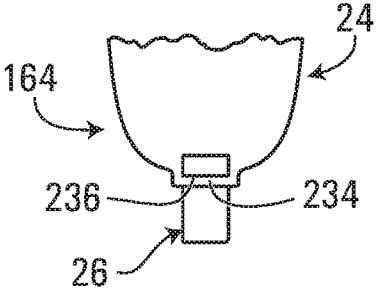
FIGS. 28 to 31 show different examples of embodiments in which the blade is affixed to the blade holder of the skating device of the skate.
Figure 31:
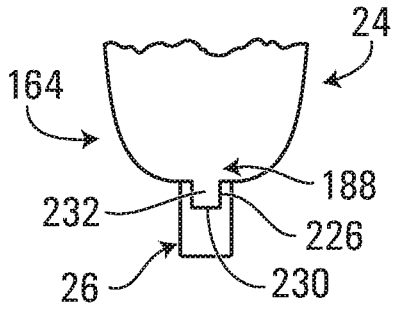

The blade holder 24 can retain the blade 26 in any suitable way. For instance, in this embodiment, the blade 26 may be permanently affixed to the blade holder 24 (i.e., not intended to be detached and removed from the blade holder 24). For example, as shown in FIG. 29, the blade 26 and the blade-retaining base 164 of the blade holder 24 may be mechanically interlocked via an interlocking portion 234 of one of the blade-retaining base 164 and the blade 26 that extends into an interlocking void 236 of the other one of the blade-retaining base 164 and the blade 26. For instance, in some cases, the blade 26 can be positioned in a mold used for molding the blade holder 24 such that, during molding, the interlocking portion 234 of the blade-retaining base 164 flows into the interlocking void 236 of the blade 26 (i.e., the blade holder 24 is overmolded onto the blade 26). In some embodiments, as shown in FIGS. 28 to 31, the blade holder 24 may retain the blade 26 using an adhesive 226 and/or one or more fasteners 228. For instance, in some embodiments, as shown in FIG. 28, the recess 190 of the blade holder 24 may receive the upper portion of the blade 26 that is retained by the adhesive 226. The adhesive 226 may be an epoxy-based adhesive, a polyurethane-based adhesive, or any suitable adhesive. In some embodiments, instead of or in addition to using an adhesive, as shown in FIG. 29, the recess 190 of the blade holder 24 may receive the upper part of the blade 26 that is retained by the one or more fasteners 228. Each fastener 228 may be a rivet, a screw, a bolt, or any other suitable mechanical fastener. Alternatively or additionally, in some embodiments, as shown in FIG. 31, the blade-retention portion 188 of the blade holder 24 may extend into a recess 230 of the upper part of the blade 26 to retain the blade 26 using the adhesive 226 and/or the one or more fasteners 228. For instance, in some cases, the blade-retention portion 188 of the blade-retaining base 164 of the blade holder 24 may comprise a projection 232 extending into the recess 230 of the blade 26.

In this embodiment, the blade-retaining base 164 comprises a plurality of apertures $\mathbf{208}_1$-$\mathbf{208}_4$ distributed in the longitudinal direction of the blade holder 24 and extending from the medial side 182 to the lateral side 184 of the blade holder 24. In this example, respective ones of the apertures $\mathbf{208}_1$-$\mathbf{208}_4$ differ in size. The apertures $\mathbf{208}_1$-$\mathbf{208}_4$ may have any other suitable configuration, or may be omitted, in other embodiments.

The blade-retaining base 164 may be configured in any other suitable way in other embodiments.

The support 168 is configured for supporting the skate boot 22 above the blade-retaining base 164 and transmit forces to and from the blade-retaining base 164 during skating. In this embodiment, the support 168 comprises a front pillar 210 and a rear pillar 212 which extend upwardly from the blade-retaining base 164 towards the skate boot 22. The front pillar 210 extends towards the front portion 56 of the skate boot 22 and the rear pillar 212 extends towards the rear portion 58 of the skate boot 22. The blade-retaining base 164 extends from the front pillar 210 to the rear pillar 212. More particularly, in this embodiment, the blade-retaining base 164 comprises a bridge 214 interconnecting the front and rear pillars 210, 212.

The skate 10 may be implemented in any other suitable manner in other embodiments.

For instance, in some embodiments, the fastener system 32 of the protector 16 may comprise any kind of fastener, including glue, snap buttons, a corresponding set of magnets, and so on, in addition to or in replacement of the hook-and-loop strap 152. The additional or replacement fastener may be a plantar fastener or may be located at any other suitable location of the protector 16.

In some embodiments, the protector 16 may be semi-permanent rather than being manually removable from the skate 10. For instance, the protector 16 may be only removable using tools. In some cases, the protector 16 may be designed to be affixable and removable to and from the skate 10 only by a technician. In some examples, the protector 16 may be affixed to the skate boot 22 and/or to the blade holder 24 by being riveted to the skate boot 22 and/or to the blade holder 24 and may be removable from the skate 10 by having the rivets be withdrawn from the skate 10, which often requires specific tooling. In other examples, the protector 16 may be affixed to the skate boot 22 and/or to the blade holder 24 by using screws that are screwed to the protector 16 and to the skate boot 22 and/or to the blade holder 24 and may be removable from the skate 10 by having the screws be withdrawn from the skate 10.

In some embodiments, as shown in FIGS. 33 to 36, the fastener system 32 of the protector 16 may comprise a fastener configured to be affixed to a fastener of the skate boot 22 or of the blade holder 24. For instance, in this embodiment, the plantar fastener 150 of the protector 16 comprises fastener components $\mathbf{302}_1$-$\mathbf{302}_s$ configured to be fastenable with corresponding fastener components $\mathbf{304}_1$-$\mathbf{304}_s$ that are affixed to the skate 10. In this example, the fastener components $\mathbf{302}_1$-$\mathbf{302}_5$, $\mathbf{304}_1$-$\mathbf{304}_s$ may be snap fasteners of any suitable kind (e.g. caps, sockets, posts, studs, etc.) that are riveted to the protector 16 and to the body 30 of the skate 10, respectively. During installation of the protector 16 onto the skate 10, the fastener components $\mathbf{302}_1$-$\mathbf{302}_s$, $\mathbf{304}_1$-$\mathbf{304}_s$ may be fastened to one another; during removal of the protector 16 from the skate 10, the fastener components $\mathbf{302}_1$-$\mathbf{302}_s$, $\mathbf{304}_1$-$\mathbf{304}_s$ may be unfastened from one another.

In other cases, the fastener components $\mathbf{304}_1$-$\mathbf{304}_5$ may be of any other suitable kind (e.g., glue, magnets, hook-and-loop straps, clips, and so on). Also, in other cases, the fastener components $\mathbf{304}_1$-$\mathbf{304}_s$ may be attached to respective ones of the protector 16 and the skate 10 by any suitable means (e.g., by being glued, by being sewed, by mechanical interlock during or after molding, etc.), depending on the type of fastener that is being used.

In some embodiments, the cover 18 of the protector 16 may be formed of only one layer comprising any suitable material, including polymeric materials, resins, kevlar, rubber, composite material, and so on.

Figure 37:
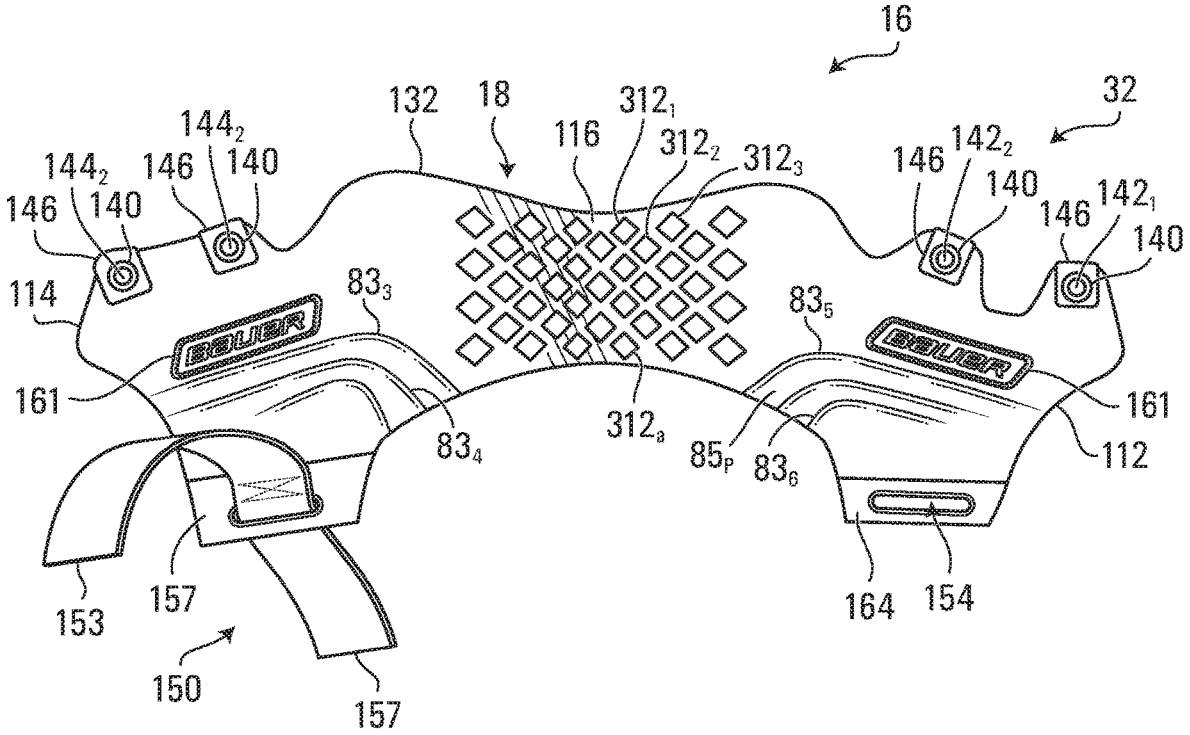
FIGS. 37 to 42 show the skate and/or the protector according to further variants.

In some embodiments, as shown in FIG. 37, the cover 18 of the protector 16 may comprise apertures $\mathbf{312}_1$-$\mathbf{312}_a$ configured for diminishing the weight of the cover 18 while limiting the diminution of the protection of the protector 16. For instance, in this example, the apertures $\mathbf{312}_1$-$\mathbf{312}_a$ are generally located on the heel wall 116, which overlies the heel portion 21 of the skate boot 22 which generally offers a relatively good protection to the user. It is understood, however, that in some cases the apertures $\mathbf{312}_1$-$\mathbf{312}_a$ may be on any portion of the cover 18. In some embodiments, also, the addition of apertures $\mathbf{312}_1$-$\mathbf{312}_a$ may allow to increase a thickness of the cover 18 to enhance impact protection while limiting the addition of weight that is cause by the increase of thickness.

Figure 38:
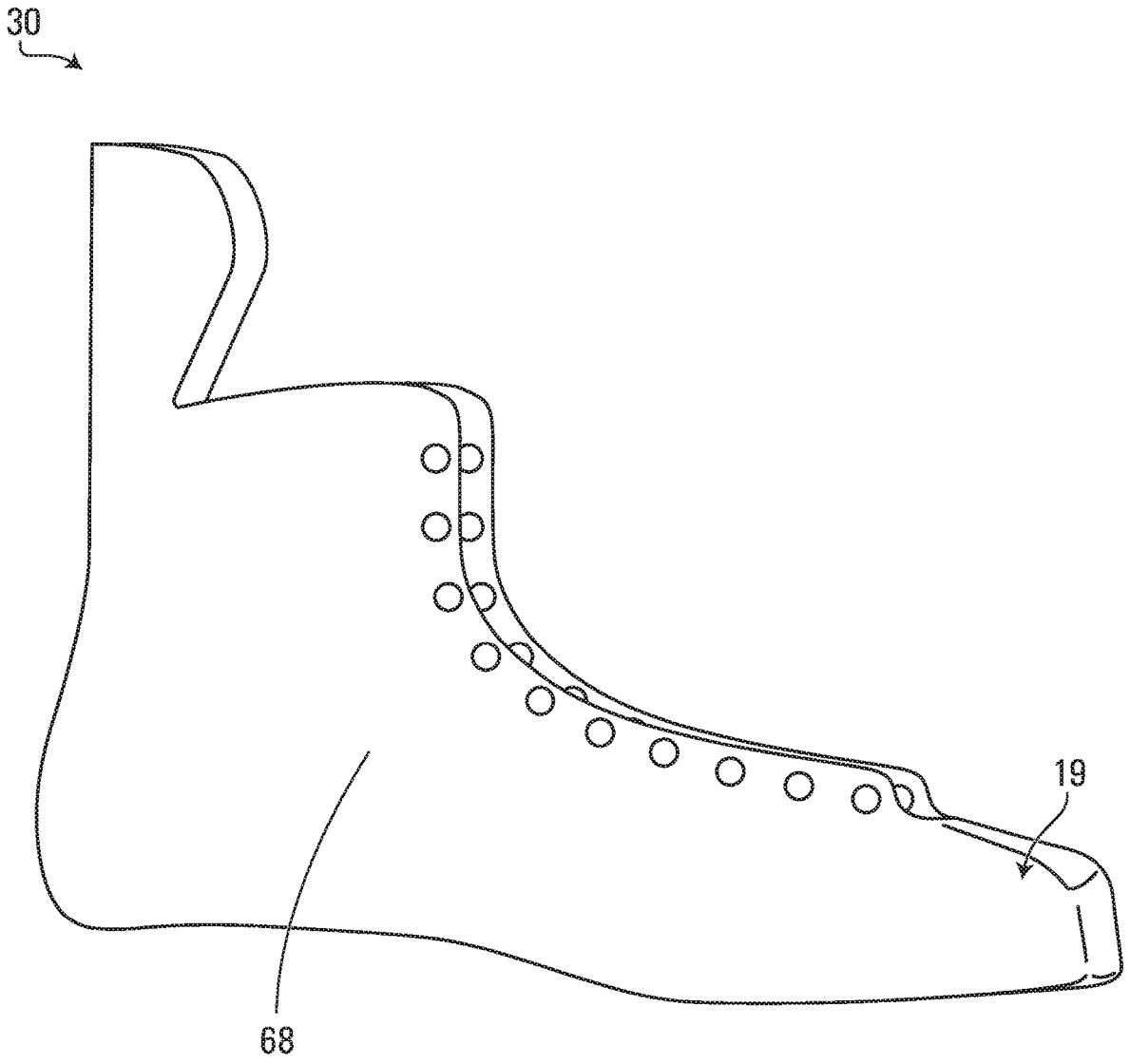
Figure 39:
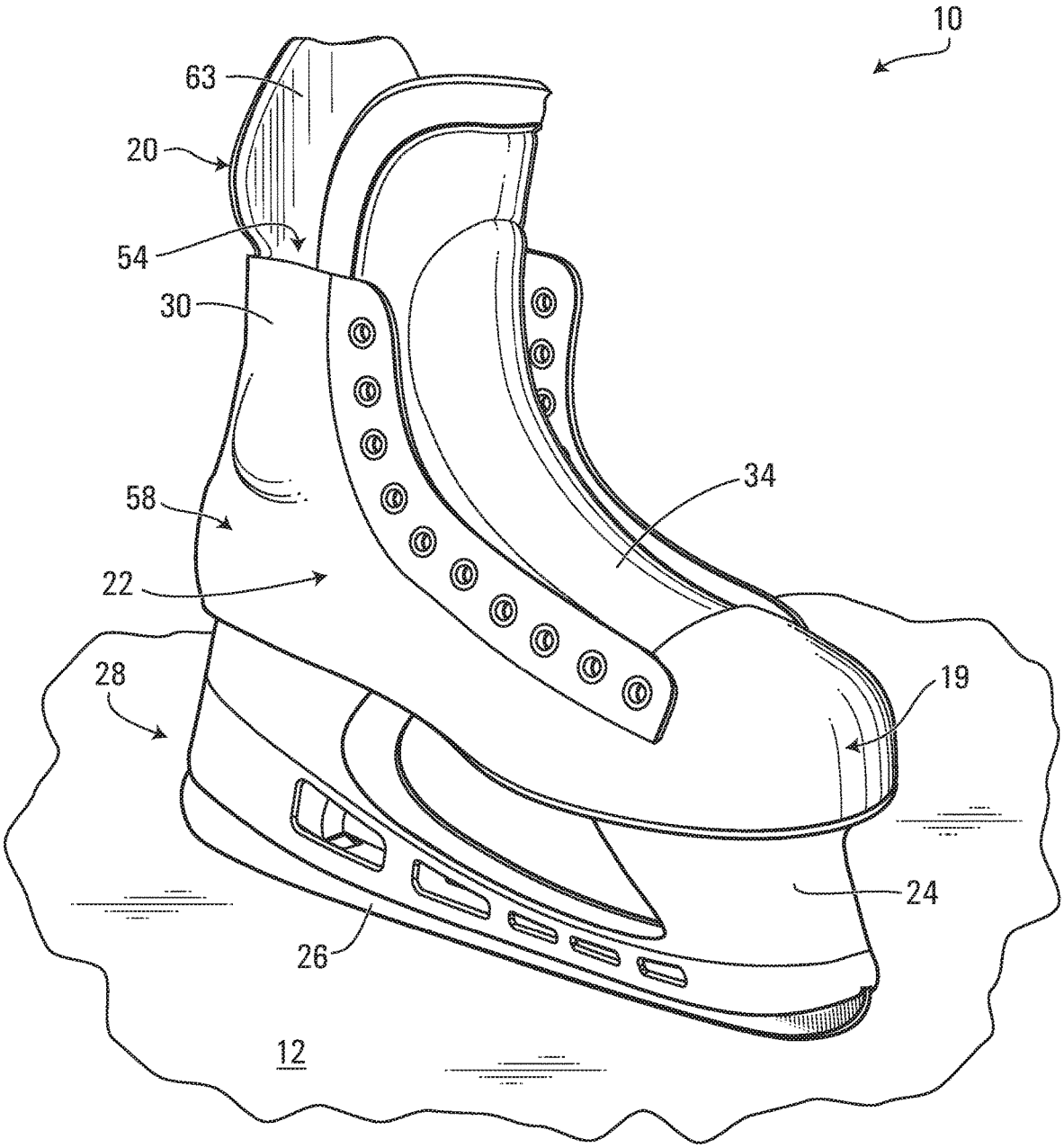
Figure 40:
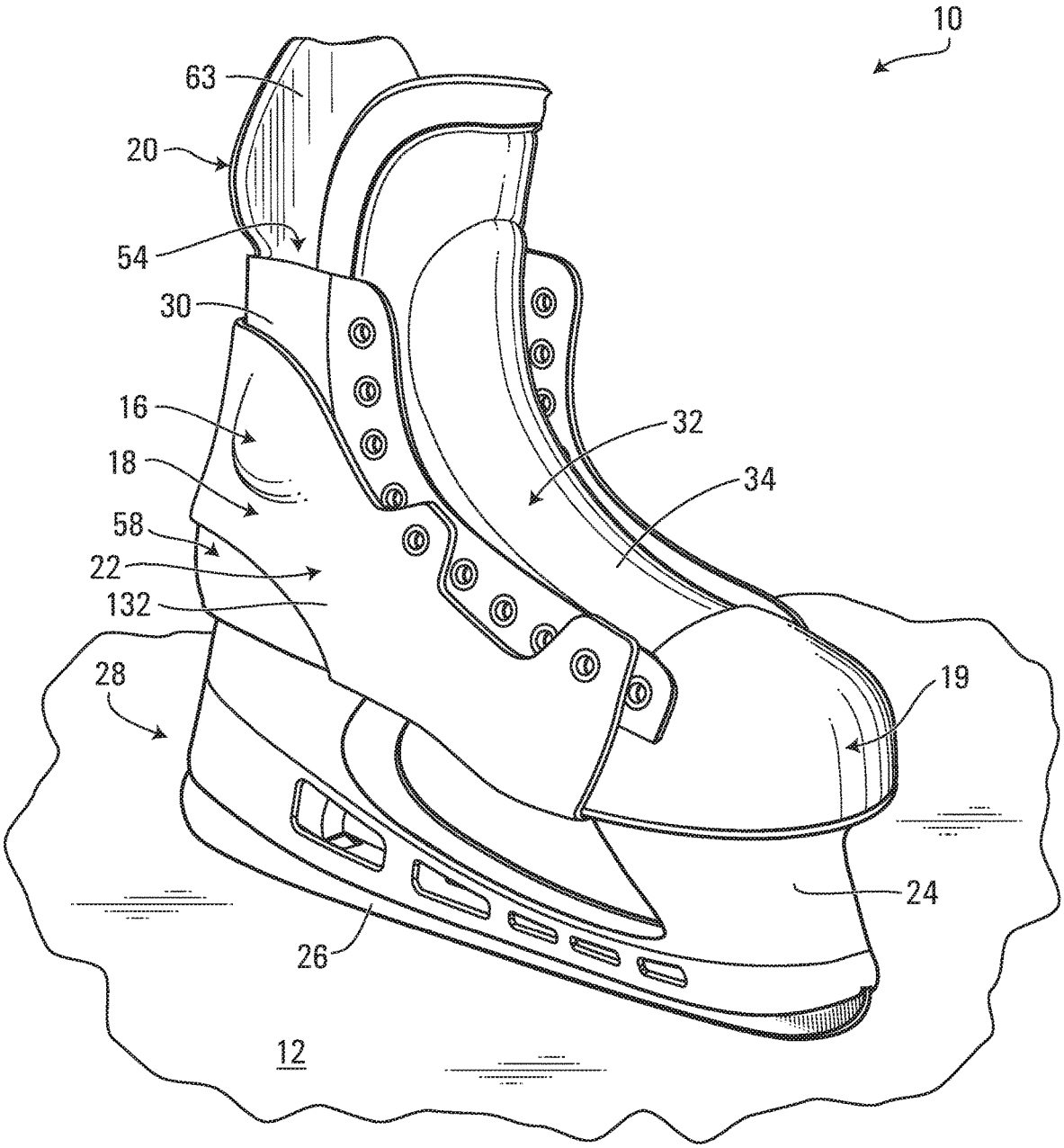

In some embodiments, as shown in FIGS. 38 to 40 instead of including the toe cap 14 that is separate from and fastened to the body 30 of the skate boot 22, the toe portion 19 of the skate boot 22 may be an integral part of the body 30 that is molded together with the medial and lateral side portions 66, 68 of the body 30.

Figure 32:
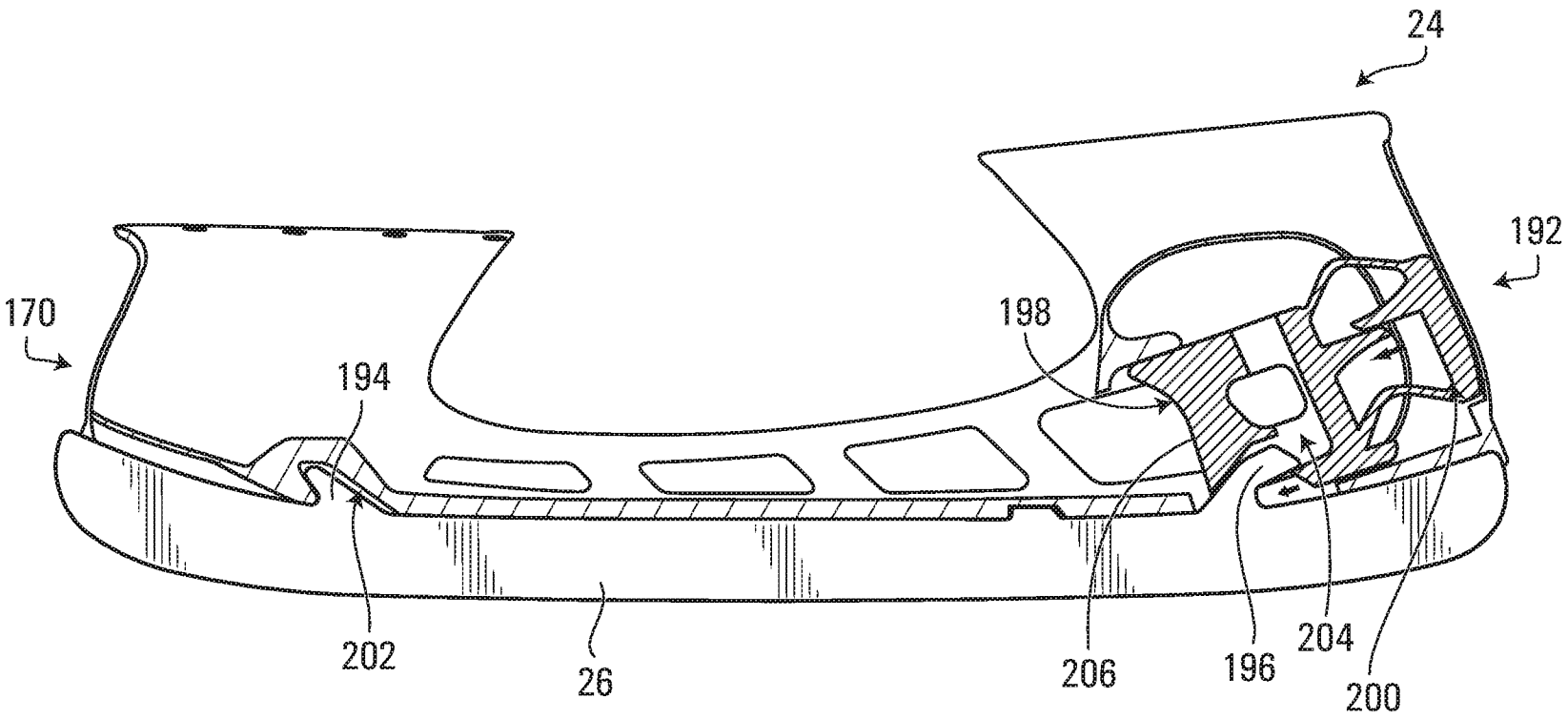
FIG. 32 is a cross-sectional view of the blade holder in an embodiment in which the blade holder comprises a blade-detachment mechanism.
Figure 33:
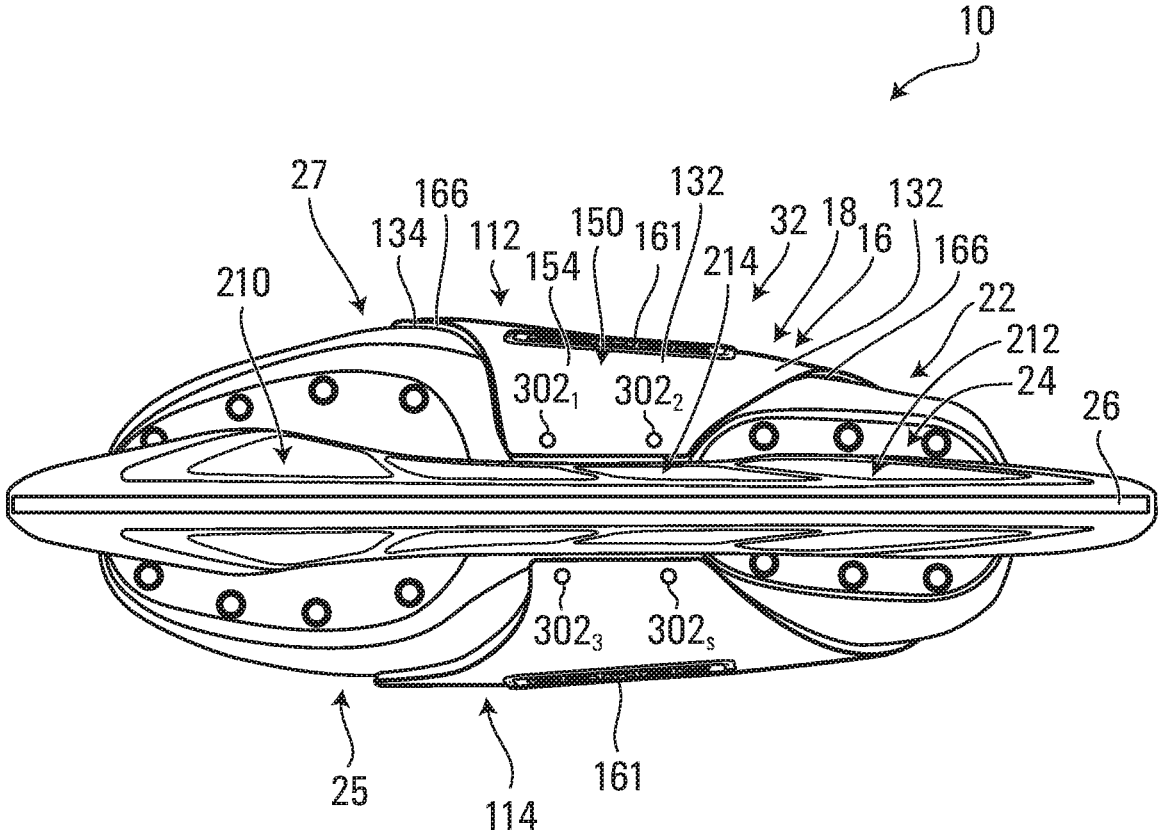
FIGS. 33 to 36 show the skate and/or the protector according to a variant of the protector.
Figure 34:
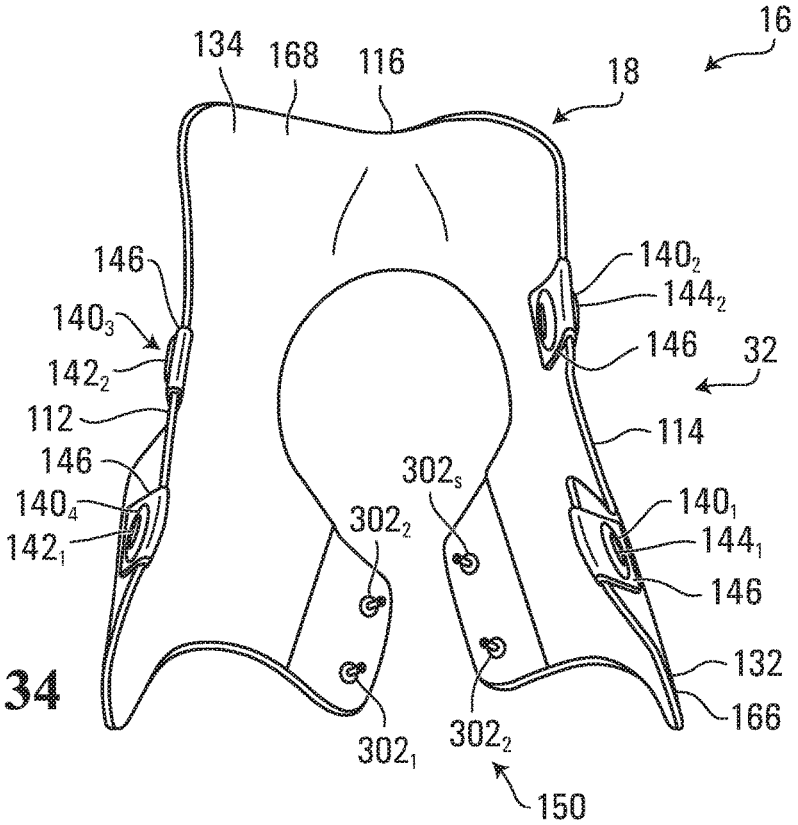
Figure 35:
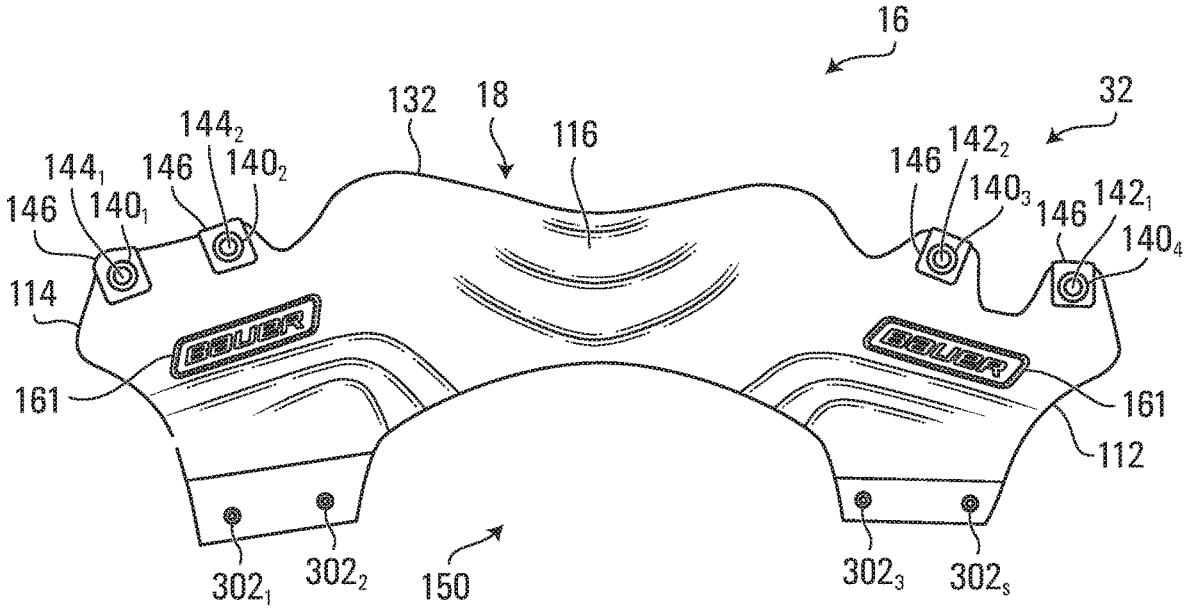
Figure 36:
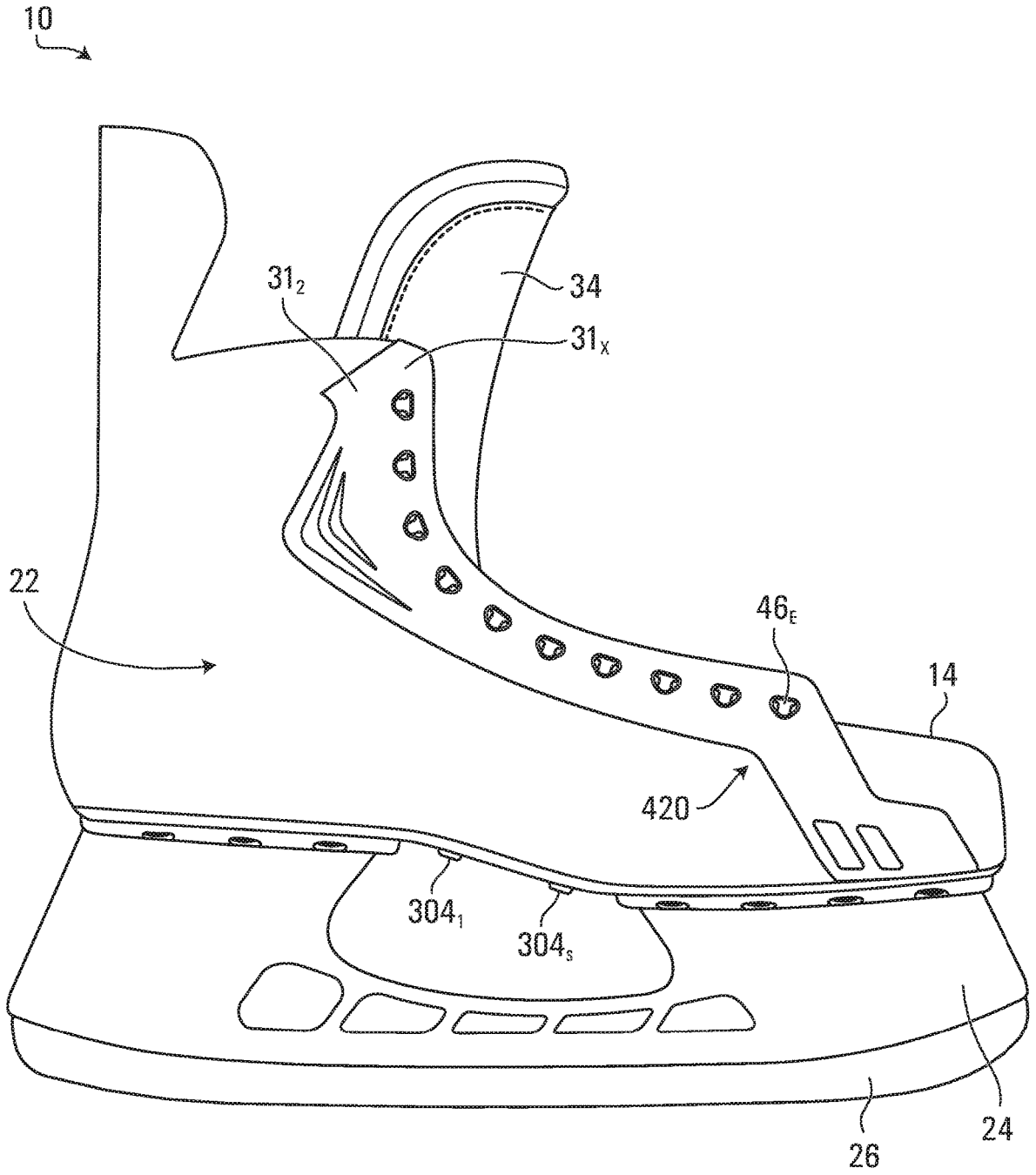

In some embodiments, the blade holder 24 may retain the blade 26 in any other suitable way. For example, in other embodiments, as shown in FIG. 32, the blade holder 24 comprises a blade-detachment mechanism 192 such that the blade 26 is selectively detachable and removable from, and attachable to, the blade holder 24 (e.g., when the blade 26 is worn out or otherwise needs to be replaced or removed from the blade holder 24).

More particularly, in this embodiment, the blade 26 includes a plurality of projections 194, 196. The blade-detachment mechanism 192 includes an actuator 198 and a biasing element 200 which biases the actuator 198 in a direction towards the front portion 170 of the blade holder 24. In this embodiment, the actuator 198 comprises a trigger. To attach the blade 26 to the blade holder 24, the front projection 194 is first positioned within a hollow space 202 (e.g., a recess or hole) of the blade holder 24. The rear projection 196 can then be pushed upwardly into a hollow space 204 (e.g., a recess or hole) of the blade holder 24, thereby causing the biasing element 200 to bend and the actuator 198 to move in a rearward direction. In this embodiment, the rear projection 196 will eventually reach a position which will allow the biasing element 200 to force the actuator 198 towards the front portion 170 of the blade holder 24, thereby locking the blade 26 in place. The blade 26 can then be removed by pushing against a finger-actuating surface 206 of the actuator 198 to release the rear projection 196 from the hollow space 204 of the blade holder 24. Thus, in this embodiment, the blade-detachment mechanism 192 is free of any threaded fastener (e.g., a screw or bolt) to be manipulated to detach and remove the blade 26 from the blade holder 24 or to attach the blade 26 to the blade holder 24.

Further information on examples of implementation of the blade-detachment mechanism 192 in some embodiments may be obtained from U.S. Pat. No. 8,454,030 hereby incorporated by reference herein. The blade-detachment mechanism 192 may be configured in any other suitable way in other embodiments.

Figure 41:
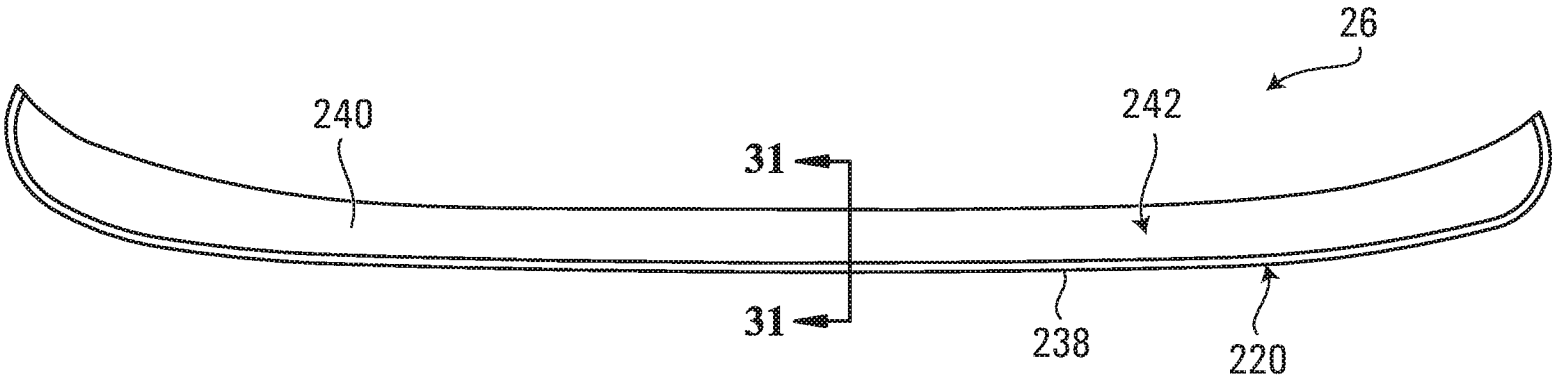
Figure 42:
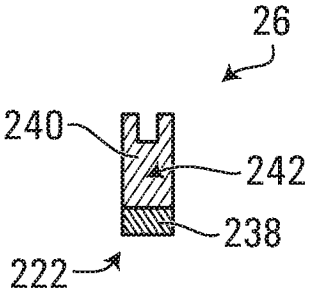

The blade 26 may be implemented in any other suitable way in other embodiments. For example, in some embodiments, as shown in FIGS. 41 and 42, the blade 26 may comprise a lower member 238 that is made of the ice-contacting material 220 and includes the ice-contacting surface 222 and an upper member 240 connected to the lower member 238 and made of a material 242 different from the ice-contacting material 220. The lower member 238 and the upper member 240 of the blade 26 may be retained together in any suitable way. For example, in some cases, the lower member 238 may be adhesively bonded to the upper member 240 using an adhesive. As another example, in addition to or instead of being adhesively bonded, the lower member 238 and the upper member 240 may be fastened using one or more fasteners (e.g., rivets, screws, bolts, etc.). As yet another example, the lower member 238 and the upper member 240 may be mechanically interlocked by an interlocking portion of one of the lower member 238 and the upper member 240 that extends into an interlocking space (e.g., one or more holes, one or more recesses, and/or one or more other hollow areas) of the other one of the lower member 238 and the upper member 240 (e.g., the upper member 240 may be overmolded onto the lower member 238).

Although in embodiments considered above the skate 10 is designed for playing ice hockey on the skating surface 12 which is ice, in other embodiments, the skate 10 may be constructed using principles described herein for playing roller hockey or another type of hockey (e.g., field or street hockey) on the skating surface 12 which is a dry surface (e.g., a polymeric, concrete, wooden, or turf playing surface or any other dry surface on which roller hockey or field or street hockey is played). Thus, in other embodiments, instead of comprising the blade 26, the skating device 28 may comprise a set of wheels to roll on the dry skating surface 12 (i.e., the skate 10 may be an inline skate or other roller skate).

In some examples of implementation, any feature of any embodiment described herein may be used in combination with any feature of any other embodiment described herein.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

In case of any discrepancy, inconsistency, or other difference between terms used herein and terms used in any document incorporated by reference herein, meanings of the terms used herein are to prevail and be used.

Although various embodiments have been illustrated, this was for purposes of description but should not be limiting. Various modifications will become apparent to those skilled in the art.

The invention claimed is:

1. A protector for protecting a skate and a foot of a user against impacts, the skate comprising a skate boot defining a cavity configured to receive the user's foot, the skate boot comprising a medial side portion configured to face a medial side of the user's foot, a lateral side portion configured to face a lateral side of the user's foot, an ankle portion configured to receive an ankle of the user, a back portion configured to face a back of the user's foot including a heel of the user's foot, a sole portion configured to face a plantar surface of the user's foot, and a toe portion configured to receive toes of the user's foot, the skate comprising a skating device disposed beneath the skate boot to engage a skating surface, the protector comprising:

a cover configured to cover and provide impact protection to at least part of the medial side portion of the skate boot, at least part of the lateral side portion of the skate boot, and at least part of the back portion of the skate boot, the cover comprising an inner side configured to face and engage the skate boot and an outer side configured to face away from the skate boot, the cover being shaped to conform to an external surface of the skate boot, the external surface of the skate boot comprises a projection, the cover comprising a plurality of formations that are formed during original manufacturing of the protector, defined by at least one of the inner side and the outer side of the cover, and at least one of projecting and receding from adjacent parts of the cover, a given one of the formations of the cover comprising a projection configured to register with the projection of the external surface of the skate boot; and a fastening system configured to fasten the protector to the skate;

wherein the protector allows the user to don and doff the skate while the fastening system fastens the protector to the skate.

2. The protector of claim 1, wherein the cover is configured to cover and protect at least a majority of the lateral side portion of the skate boot.

3. The protector of claim 1, wherein the cover is configured to cover and protect at least part of the ankle portion of the skate boot.

4. The protector of claim 3, wherein the cover is configured to cover and protect at least a majority of the ankle portion of the skate boot.

5. The protector of claim 1, wherein the cover is configured to cover and protect at least a majority of the medial side portion of the skate boot.

6. The protector of claim 1, wherein the cover is configured to cover and protect at least part of a heel region of the back portion of the skate boot.

7. The protector of claim 1, wherein: the skate boot comprises an instep portion disposed between the medial side portion and the lateral side portion of the skate boot and configured to face an instep of the user's foot; and the cover is configured to leave the instep portion of the skate boot exposed.

8. The protector of claim 1, wherein: the skate boot comprises an instep portion disposed between the medial side portion and the lateral side portion of the skate boot and configured to face an instep of the user's foot; and the cover is configured to define an opening over the instep portion of the skate boot.

9. The protector of claim 1, wherein: the skate boot comprises a tongue extending between the medial side portion and the lateral side portion of the skate boot and configured to face an instep of the user's foot; and the cover is configured to leave the tongue exposed where the tongue faces the instep of the user's foot.

10. The protector of claim 1, wherein: the skate boot comprises a tongue extending between the medial side portion and the lateral side portion of the skate boot and configured to face an instep of the user's foot;

and the cover is configured to define an opening over the tongue.

11. The protector of claim 1, wherein the cover is configured to cover at least part of the skate boot without extending over a top surface of the user's foot.

12. The protector of claim 1, wherein: the skate boot comprises a lace for tightening the skate boot about the user's foot; and the fastening system comprises a lacing opening configured to receive the lace.

13. The protector of claim 12, wherein: the skate boot comprises a lacing opening to receive the lace; and the lacing opening of the fastening system is configured to be aligned with the lacing opening of the skate boot.

14. The protector of claim 12, wherein the fastening system comprises an eyelet about the lacing opening of the fastening system.

15. The protector of claim 1, wherein the cover comprises: a lateral wall configured to cover and protect at least part of the lateral side portion of the skate boot; a medial wall configured to cover and protect at least part of the medial side portion of the skate boot; and a back wall configured to cover and protect at least part of the back portion of the skate boot and shorter than each of the lateral wall and the medial wall in a heightwise direction of the protector.

16. The protector of claim 15, wherein each of the medial wall, the lateral wall and the back wall comprises a first layer configured to primarily disperse impact energy and a second layer configured to primarily absorb impact energy.

17. The protector of claim 1, wherein the cover comprises composite material.

18. The protector of claim 17, wherein the composite material is a self-reinforced polymeric material.

19. The protector of claim 1, wherein at least a majority of the cover is opaque.

20. The protector of claim 1, wherein the cover comprises a plurality of layers that include a plurality of materials different from one another.

21. The protector of claim 20, wherein an inner one of the layers of the cover is softer than an outer one of the layers of the cover.

22. The protector of claim 20, wherein a first one of the layers of the cover comprises foam and a second one of the layers of the cover comprises a non-foam material.

23. The protector of claim 20, wherein a first one of the layers is configured to primarily disperse impact energy and a second one of the layers is configured to primarily absorb impact energy.

24. The protector of claim 1, wherein the cover is shaped during original manufacturing to conform to the external surface of the skate boot.

25. The protector of claim 1, wherein the given one of the formations of the cover comprises a recess configured to receive the projection of the external surface of the skate boot.

26. The protector of claim 1, wherein the projection of the skate boot is a malleolus projection configured to face a malleolus of the user.

27. The protector of claim 1, wherein the projection of the skate boot is an elongate reinforcing projection.

28. The protector of claim 1, wherein an appearance of the outer side of the cover is configured to emulate an appearance of an exterior of the skate boot.

29. The protector of claim 28, wherein the outer side of the cover includes a graphic configured to emulate a graphic of the exterior of the skate boot.

30. The protector of claim 28, wherein the outer side of the cover includes a color configured to emulate a color of the exterior of the skate boot.

31. The protector of claim 28, wherein the outer side of the cover includes a pattern configured to emulate a pattern of the exterior of the skate boot.

32. The protector of claim 28, wherein the outer side of the cover includes a logo configured to emulate a logo of the exterior of the skate boot.

33. The protector of claim 1, wherein the fastening system comprises a fastener configured to be disposed under the skate boot.

34. The protector of claim 33, wherein: the skate is an ice skate; the skating device comprises a blade and a blade holder that is disposed between the skate boot and the blade to hold the blade; the blade holder comprises a first pedestal and a second pedestal spaced from one another in a longitudinal direction of the skate; and the fastener is configured to be disposed between the first pedestal and the second pedestal in the longitudinal direction of the blade holder.

35. The protector of claim 33, wherein the fastener comprises a hook-and-loop fastener.

36. A skate comprising the protector of claim 1.

37. The protector of claim 1, wherein the cover comprises: a lateral wall configured to cover and protect at least part of the lateral side portion of the skate boot; a medial wall configured to cover and protect at least part of the medial side portion of the skate boot; and a back wall configured to cover and protect at least part of the back portion of the skate boot and formed integrally with the lateral wall and the medial wall.

38. A protector for protecting a skate and a foot of a user against impacts, the skate comprising a skate boot defining a cavity configured to receive the user's foot, the skate boot comprising a medial side portion configured to face a medial side of the user's foot, a lateral side portion configured to face a lateral side of the user's foot, an ankle portion configured to receive an ankle of the user, a back portion configured to face a back of the user's foot including a heel of the user's foot, a sole portion configured to face a plantar surface of the user's foot, and a toe portion configured to receive toes of the user's foot, the skate comprising a skating device disposed beneath the skate boot to engage a skating surface, the protector comprising:

a. a cover configured to cover and provide impact protection to at least part of the skate boot, the cover comprising a medial wall configured to cover and protect at least part of the medial side portion of the skate boot, a lateral wall configured to cover and protect at least part of the lateral side portion of the skate boot, and a back wall configured to cover and protect at least part of the back portion of the skate boot, the cover being shaped to conform to an external surface of the skate boot, the external surface of the skate boot comprising a projection, the cover including an inner side configured to face and engage the skate boot and an outer side configured to face away from the skate boot, the cover comprising a plurality of formations that are formed during original manufacturing of the protector, defined by at least one of the inner side and the outer side of the cover, and at least one of projecting and receding from adjacent parts of the cover, a given one of the formations of the cover comprising a projection configured to register with the projection of the external surface of the skate boot, the cover comprising a plurality of layers that include a plurality of materials different from one another, a first one of the layers being disposed outwardly of and stiffer than a second one of the layers; and b. a fastening system configured to fasten the protector to the skate.

39. A protector for protecting a skate and a foot of a user against impacts, the skate comprising a skate boot defining a cavity configured to receive the user's foot, the skate comprising a skating device disposed beneath the skate boot to engage a skating surface, the protector comprising:

a. a cover configured to cover and provide impact protection to at least part of the skate boot, the cover comprising an inner side configured to face and engage the skate boot and an outer side configured to face away from the skate boot, the cover comprising a plurality of formations that are formed during original manufacturing of the protector, defined by at least one of the inner side and the outer side of the cover, at least one of projecting and receding from adjacent parts of the cover, an appearance of the outer side of the cover being configured to emulate an appearance of an exterior of the skate boot, a given one of the formations of the cover comprising a projection configured to register with a projection of the exterior of the skate boot; and b. a fastening system configured to fasten the protector to the skate.

* * * * *